US010576322B2

(12) United States Patent
Schlegel

(10) Patent No.: US 10,576,322 B2
(45) Date of Patent: Mar. 3, 2020

(54) MODULAR EXERCISE APPARATUS

(71) Applicant: Anthony Schlegel, Worthington, OH (US)

(72) Inventor: Anthony Schlegel, Worthington, OH (US)

( * ) Notice: Subject to any disclaimer, the term of this patent is extended or adjusted under 35 U.S.C. 154(b) by 103 days.

(21) Appl. No.: 15/904,642

(22) Filed: Feb. 26, 2018

(65) Prior Publication Data

US 2018/0243597 A1 Aug. 30, 2018

Related U.S. Application Data

(60) Provisional application No. 62/463,199, filed on Feb. 24, 2017.

(51) Int. Cl.
*A63B 17/04* (2006.01)
*A63B 21/00* (2006.01)
(Continued)

(52) U.S. Cl.
CPC ..... *A63B 17/04* (2013.01); *A63B 21/40* (2015.10); *A63B 22/20* (2013.01); *A63B 23/047* (2013.01); *A63B 23/1227* (2013.01); *A63B 69/34* (2013.01); *A63B 69/345* (2013.01); *A63B 71/023* (2013.01); *A63B 21/0728* (2013.01); *A63B 21/4035* (2015.10); *A63B 47/00* (2013.01); *A63B 69/002* (2013.01); *A63B 69/0026* (2013.01); *A63B 69/0071* (2013.01); *A63B 2071/025* (2013.01); *A63B 2102/14* (2015.10); *A63B 2102/24* (2015.10);
(Continued)

(58) Field of Classification Search
CPC ..... A63B 17/04; A63B 71/023; A63B 69/345; A63B 23/047; A63B 22/20; A63B 69/34; A63B 23/1227; A63B 21/40; A63B 69/002; A63B 2225/093; A63B 2225/09; A63B 69/0071; A63B 69/0026; A63B 2071/025; A63B 21/0728; A63B 2102/14; A63B 2225/105; A63B 21/4035; A63B 2243/0037; A63B 47/00; A63B 2102/24
See application file for complete search history.

(56) References Cited

U.S. PATENT DOCUMENTS 2,473,076 A 6/1947 Scheibner
2,558,081 A * 6/1951 Gardenhour ..... A63B 69/345 473/445
(Continued)

*Primary Examiner* — Andrew S Lo
(74) *Attorney, Agent, or Firm* — Jason H. Foster; Kremblas & Foster

(57) ABSTRACT

An exercise apparatus with base horizontal members forming a base polygon and ceiling horizontal members forming a ceiling polygon and a plurality of vertical members mounted at their lower ends to the base polygon and mounting the ceiling polygon spaced from the base polygon. A human interface permits athletes to exercise, and wheels mounted to the base polygon permit transport of the apparatus and attached equipment to a field or court. The base polygon includes two parallel skids and the human interface may be a pad permitting an athlete to push the apparatus horizontally when none or two of the wheels contact the ground. When no wheels contact the ground, the apparatus may be used in the manner of a weight rack, because the apparatus will not move along the ground without substantial force being applied.

16 Claims, 17 Drawing Sheets

(51) Int. Cl.

| | |
|---|---|
| ***A63B 23/12*** | (2006.01) |
| ***A63B 69/34*** | (2006.01) |
| ***A63B 23/04*** | (2006.01) |
| ***A63B 22/20*** | (2006.01) |
| ***A63B 71/02*** | (2006.01) |
| *A63B 47/00* | (2006.01) |
| *A63B 102/14* | (2015.01) |
| *A63B 102/24* | (2015.01) |
| *A63B 21/072* | (2006.01) |
| *A63B 69/00* | (2006.01) |

(52) U.S. Cl.
CPC ..... *A63B 2225/09* (2013.01); *A63B 2225/093* (2013.01); *A63B 2225/105* (2013.01); *A63B 2243/0037* (2013.01)

(56) References Cited

U.S. PATENT DOCUMENTS 2,653,816 A * 9/1953 Young ..... A63B 69/345 473/445
3,216,724 A * 11/1965 Williams ..... A63B 69/345 473/445
3,326,553 A * 6/1967 Forrest ..... A63B 69/345 473/445
3,329,428 A * 7/1967 Moran ..... A63B 69/345 473/441
3,424,458 A * 1/1969 Hopps, Jr. ..... A63B 69/345 473/443
3,425,692 A * 2/1969 Leach ..... A63B 69/345 473/445
3,451,677 A * 6/1969 Nedwick ..... A63B 69/345 473/440
3,684,283 A 8/1972 Forrest
3,827,690 A 8/1974 Rogers
3,889,949 A * 6/1975 Gardner ..... A63B 69/345 473/445
4,087,089 A * 5/1978 Forrest ..... A63B 69/345 473/445
4,302,023 A 11/1981 Kiesz
4,349,213 A * 9/1982 Hirsch ..... B62B 1/00 126/283
4,447,056 A * 5/1984 Dalton ..... A63B 69/345 473/442
4,573,680 A * 3/1986 McNally ..... A63B 69/345 124/36
4,588,096 A * 5/1986 Story ..... B62B 3/006 211/126.15
D284,415 S * 6/1986 Cahoon ..... D34/17
5,800,318 A * 9/1998 Coviello ..... A61H 3/04 135/67
6,206,385 B1 * 3/2001 Kern ..... B62B 3/02 280/47.35
6,261,195 B1 * 7/2001 Shingleton ..... A63B 69/345 473/438
6,761,650 B1 * 7/2004 Dettmann ..... A63B 69/345 473/441
6,802,800 B1 10/2004 Hobson
6,824,504 B2 11/2004 Ott
6,942,585 B1 * 9/2005 Krause ..... A63B 69/002 473/445
7,416,412 B2 8/2008 Segrest et al.
7,419,063 B1 * 9/2008 Hall ..... A21B 1/44 211/126.1
7,815,552 B2 10/2010 Dibble et al.
8,002,649 B2 8/2011 Forrest, Sr.
8,360,938 B2 1/2013 Gilman
8,900,074 B1 * 12/2014 Johnson ..... A63B 69/205 473/422
8,986,172 B2 3/2015 Poole
9,192,803 B2 11/2015 Cayo
9,446,281 B2 9/2016 Abelbeck
9,492,701 B1 * 11/2016 Bognatz ..... A63B 21/072
10,124,228 B1 * 11/2018 Leto ..... A63B 69/345
2002/0077226 A1 * 6/2002 Ott ..... A63B 21/072 482/98
2002/0147061 A1 * 10/2002 Krause ..... A63B 69/004 473/445
2006/0032412 A1 * 2/2006 Harner ..... B65D 19/06 108/55.1
2007/0020594 A1 * 1/2007 Segrest ..... G09B 19/00 434/226
2008/0058128 A1 * 3/2008 Joseph ..... A63B 69/345 473/441
2011/0124443 A1 * 5/2011 Krause ..... A63B 21/0618 473/445
2013/0012364 A1 * 1/2013 Leath ..... A63B 21/012 482/66
2013/0184104 A1 * 7/2013 Gilman ..... A63B 69/345 473/445
2013/0324371 A1 * 12/2013 Cayo ..... A63B 21/0618 482/87
2014/0073491 A1 3/2014 Gilson
2014/0221131 A1 * 8/2014 Gilman ..... A63B 69/00 473/447
2015/0157892 A1 6/2015 Johnson
2015/0231475 A1 8/2015 Tompkins et al.
2017/0189736 A1 * 7/2017 Martin ..... A63B 21/4029
2017/0282008 A1 * 10/2017 Williams ..... A63B 69/12

* cited by examiner

MODULAR EXERCISE APPARATUS

BACKGROUND OF THE INVENTION

The invention relates generally to equipment for exercising, and more particularly relates to equipment that may be used for exercise and that may store and have exercise equipment mounted to it.

Football sleds are well known as being located at a football practice area so that they may be struck by athletes as a practice. A sled slides along the ground as one or more athletes push against a pad on the sled, and the sliding action resists the force applied by the athletes so the athletes build strength that is used during blocking in a contest. Football sleds are extremely useful as sleds, but they are not known to the applicant to be used for any other purpose than pushing.

Football and other sport athletes need to exercise particular muscles or muscle groups using more than just a sled. However, most exercise equipment for such athletes is either specialized, such as the sled that is left outdoors all year around, or is universal, such as barbells, weights, dip bars, etc., which are left in a weight room all year around. There is no invention known to the inventor that has the advantages of both.

BRIEF SUMMARY OF THE INVENTION

Disclosed herein is an apparatus for human exercise that functions as a rack for attaching human-interface devices, a trailer for transporting to a location outside of a gym or weightlifting room, and skids that permit the entire apparatus to be used as a fitness device in the manner of a football sled. The apparatus may include a plurality of base members that mount at or near their ends to form a base polygon, which may be a rectangle or other polygon. The base polygon rests upon a surface, such as grass, artificial turf, soil, sand, wood, cement, an all-weather track or any other surface upon which the practicing of a sport may occur. In one embodiment, the base polygon is a rectangle, the opposite, parallel sides of which rest upon the grass on a football practice field.

The apparatus also includes a plurality of vertically-oriented members that rigidly mount at lower ends to the base polygon and extend substantially upwardly therefrom to a ceiling polygon. The ceiling polygon is preferably the same shape as the base polygon and may be made of members mounted to one another and to which the vertical members rigidly mount, or the ceiling polygon members may rigidly mount to the vertical members but not to one another. In one embodiment, the ceiling polygon is mounted at or near the top ends of the vertical members, and in an alternative embodiment the ceiling polygon mounts intermediate the ends of the vertical members. In all contemplated embodiments, the ceiling polygon is spaced from the base polygon. Intermediate horizontal members may removably mount to the vertical members between the base polygon and the ceiling polygon.

The base polygon includes at least two skids that are substantially parallel to one another. The skids may be base polygon members and preferably have ends that are angled away from the surface to encourage sliding in a direction parallel to the skids. Thus, a sufficient force applied to the vertical or any other members may slide the skids relative to the surface parallel to the skids. In one embodiment, a human-interface is a pad against which an athlete may push horizontally to displace the apparatus in the manner of a football sled. Other human interfaces include dip bars and bars for hands to grasp, among others.

Multiple wheels are preferably mounted to the base polygon to selectively engage the surface in order that the apparatus may be displaced along the surface in the manner of a trailer or other passively-wheeled structure. It is contemplated that the wheels may be actively rotated, such as by a servo motor or another prime mover, but this is not critical. The wheels may be pivotable from a surface-engaging position, in which the outer circumference of each wheel is disposed below the lowest portion of the base polygon, to a surface-spaced position in which the circumference of each wheel is disposed above the lowest portion of the base polygon. Alternatively, the wheels may be removably mounted to the base polygon so that the apparatus may be used as a sled upon removal and as a trailer during attachment.

The combination of the base polygon, the ceiling polygon and the vertical members connecting the members of the base and ceiling polygons together produces a strong structure that may be a cuboid to which various exercise devices may be mounted and in which they may be stored. In one example, barbell hooks and other barbell rests, weight plate storage bars and other such structures mounted to the apparatus permit athletes to use the apparatus as a weight rack and a squat rack. The apparatus may have other human-interfaces attached thereto. The apparatus has skids that permit the apparatus to serve as a football-like sled when a selected human-interface is mounted thereto, such as a vertically-oriented pad. Thus, the apparatus has football sled features. Because wheels are mounted to the base polygon, the apparatus also has trailer features because it may be pushed or pulled, by humans or by machines, to and from workout sites, such as fields, courts, pitches and any practice location. Thus, the apparatus described herein has features of a rack, a trailer and a sled.

Figure 1:
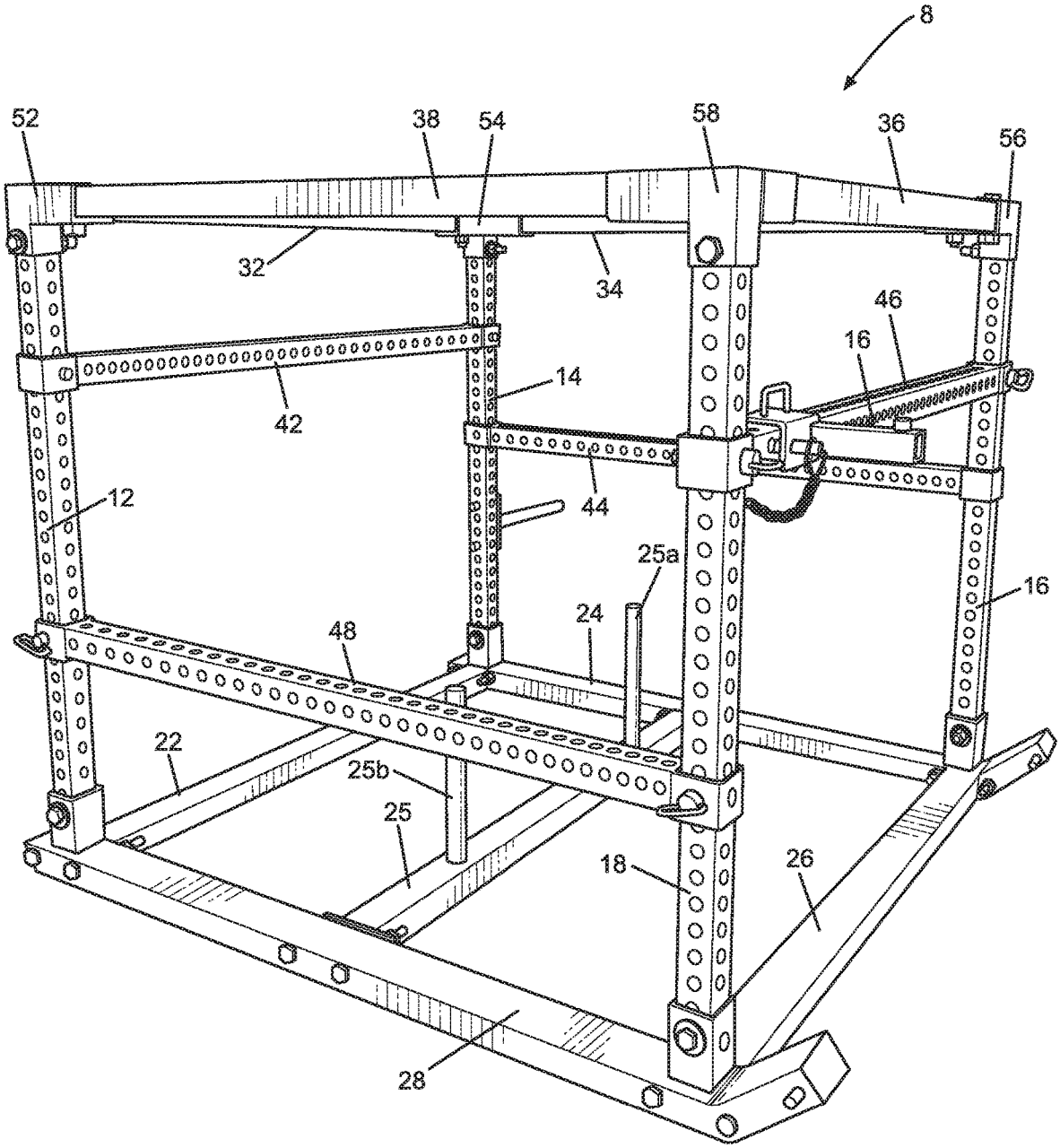
FIG. 1 is a view in perspective illustrating an embodiment of the present invention.
Figure 2:
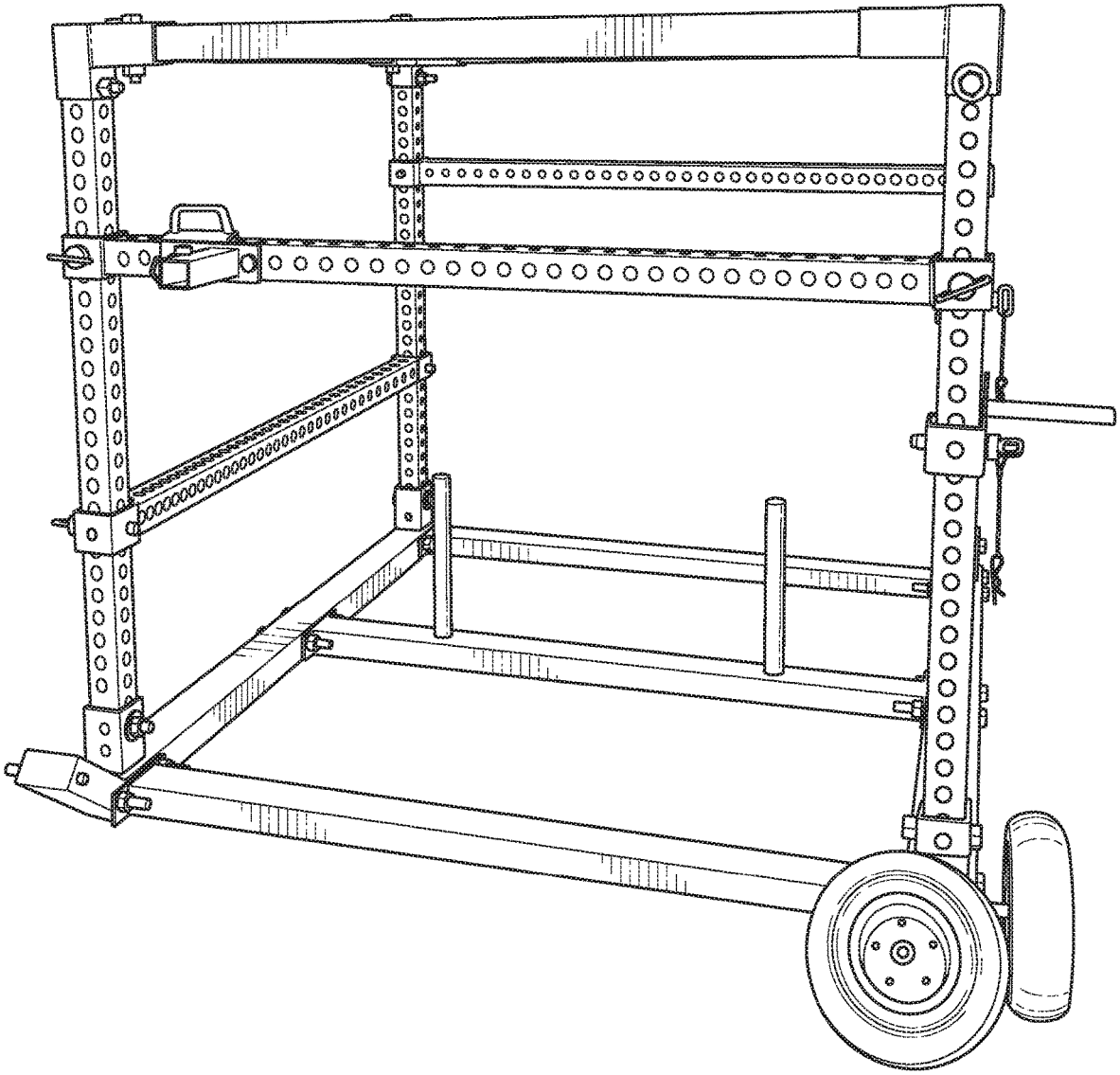
FIG. 2 is a view in perspective illustrating the embodiment of FIG. 1.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 62/463,199 filed Feb. 24, 2017 is incorporated herein by reference.

A highly modular workout apparatus 8 is shown in FIG. 1 made of a plurality of members that are rigidly attached together, many at or near their ends, to make up a frame of the apparatus 8. The frame is sufficiently rigid so that impacts by human users of the apparatus 8 do not significantly distort or break the members. Furthermore, human impacts do not affect the connections between each of the members. Each of the members may be tubular (hollow) steel or another strong material, and each may have a cross-sectional shape that is preferably rectangular, but may be circular or another shape. Each member may be attached to another member using conventional removable fasteners, such as bolts, screws and pins, and alternatively the members may be attached by weldments, adhesives and other non-removable fasteners.

The apparatus 8 is used for three main purposes. First, the apparatus 8 may hold human-interface structures that are used by athletes to train on. These structures permit humans to interface with the apparatus 8 when the apparatus is stationary, and include, without limitation, striking surfaces, dip bars, pull-up bars, handles, high rotation bars (barbells with weights near one and with the opposite end inserted into a hinged structure), and many others. Second, the apparatus 8 may be used by one or more athletes when it is not stationary during a workout, such as by the athlete moving the apparatus 8 in the manner of a sled. One or more athletes may strike (and continue to push against) a surface, which may be a vertically-oriented padded structure about the size of a human torso, or may push or pick up one or more sides of the apparatus 8 using a handle or rod, and drag or pull the apparatus 8 in the manner of a sled. The apparatus 8 is designed to have such handle or striking surface structures mounted in various locations on the apparatus 8 to provide flexibility and modularity. Third, the apparatus 8 and its attached structures may be left outdoors without damage from weather or may be moved around in the manner of a trailer. Thus, an athletic trainer may locate workout equipment wherever a playing field or other space is located by mounting workout equipment to the apparatus 8 and transporting the apparatus 8 to that location. This may be a football field, soccer field, baseball field, lacrosse field, basketball court, tennis court, hockey rink, or any other training facility.

The apparatus 8 is made up of a plurality of members connected together, which may be assembled and disassembled conveniently to move and store the apparatus 8 if it is not desirable to move the apparatus 8 like a trailer using the wheels. Four of the members 12, 14, 16 and 18 may be vertically-oriented in the configuration shown in FIG. 1, and each may be disposed with its lower end (in the configuration shown in FIG. 1) at or near one of four spaced corners of a base of the apparatus 8. Each upper end may be located at one of four spaced corners of a ceiling of the apparatus 8. The vertical members 12-18 may be about seven feet long, but this is not critical. It is contemplated that the members may be several feet longer or shorter.

Four of the members 22, 24, 26 and 28 may be horizontally-oriented at or near the lower end of the four vertical members (in the configuration shown in FIG. 1), thereby forming the base polygon of the apparatus 8. The base polygon is in the form of a rectangle in the embodiment of FIG. 1, but a person having ordinary skill will understand how to form a base into a differently-shaped polygon, such as a triangle, hexagon, or any multiple-sided irregular shape. Four of the members 32, 34, 36 and 38 may be horizontally-oriented at or near the top of the four vertical members (in the configuration shown in FIG. 1), thereby forming the ceiling polygon for the apparatus 8. The ceiling is in the form of a rectangle, but a person having ordinary skill will understand how to form a ceiling into a differently-shaped polygon, such as a triangle, hexagon, or any irregular shape. The frame members 12-18, 22-28 and 32-38 may form a cuboid as shown in FIG. 1 when the vertical members form right angles with the base and ceiling members. The base members 22-28 and the ceiling members 32-38 may each be about six feet long, but this is not critical. It is contemplated that the members may be several feet longer or shorter.

Four intermediate members 42, 44, 46 and 48 are horizontally-oriented and may be positioned on the vertically-oriented members 12-18 intermediate the base horizontally-oriented members 22-28 and the ceiling horizontally-oriented members 32-38. Each of these intermediate members 42-48 is moveably-mounted at opposite ends to pairs of the vertical members 12-18. For example, the intermediate member 42 is mounted at opposite ends to the pair of vertical members 12 and 14, as shown in FIG. 1. The intermediate members may be about six feet long, but this is not critical. It is contemplated that the members may be several feet longer or shorter. It is contemplated to interpose a vertical member (not shown) between the vertical members 12-18 that are positioned in the corners of the cuboid in order to permit a shorter intermediate member to extend between corner vertical members 12-18 and the interposed vertical member, rather than extending between corner vertical members 12-18. This would make the intermediate members shorter, which may provide an advantage.

Figure 7:
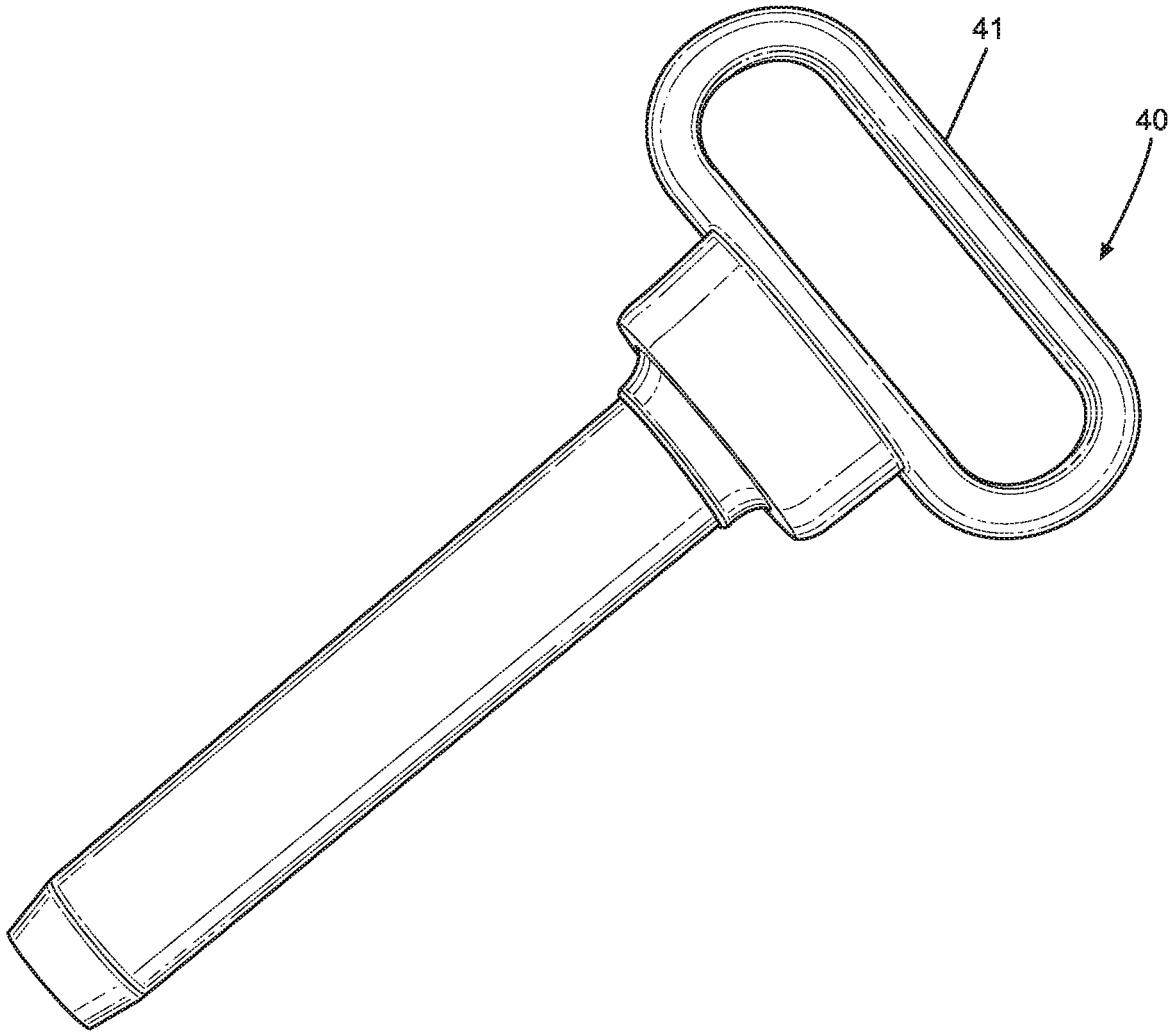
FIG. 7 is a view in perspective illustrating a pin.

Each of the intermediate members 42-48 may mount to the vertical members 12-18 at rectangular collars that are rigidly mounted to opposing ends of the intermediate members, and that receive the vertical members. Subsequently, the shaft of a pin, such as the hitch pin 40 shown in FIG. 7, may be inserted through aligned holes formed through the collar and also through aligned holes 10 formed in the vertical members 12-18. A hitch pin clip (not shown, but conventional) is inserted through an aperture formed in the end of the shaft of the hitch pin 40 distal from the handle 41. Alternatively, U-shaped members may be mounted to opposite ends of the intermediate members 42-48 to surround the vertical members on three sides, rather than four as with the collars, and pins extend through aligned apertures in the U-shaped members and through aligned apertures in the vertical members. Any conventional fastener is contemplated for mounting the intermediate members 42-48 to vertical members.

Figure 5:
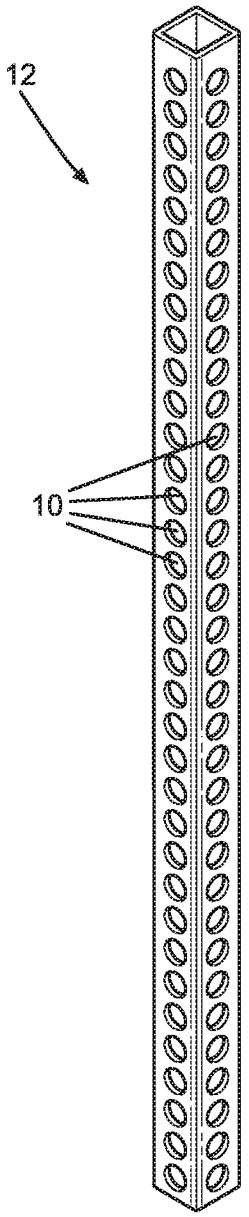
FIG. 5 is a view in perspective illustrating a first side of a member of the apparatus.
Figure 6:
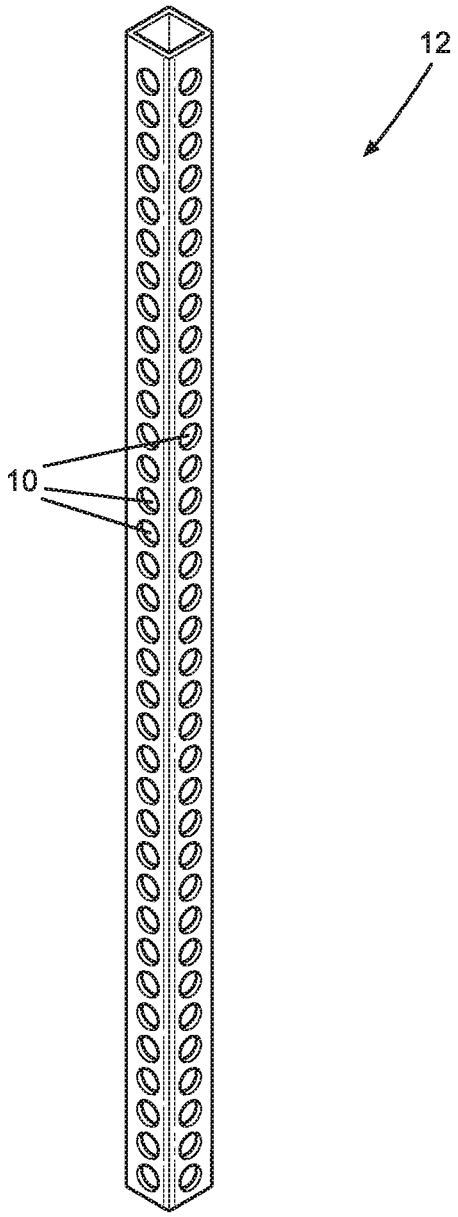
FIG. 6 is a view in perspective illustrating a second, opposite side of the member of FIG. 5.

Each of the vertically-oriented members 12-18 may have holes 10 formed through all sides extending transverse to the length of the member, and the holes 10 may be disposed at equal distances from next adjacent holes, along substantially the entire length of the member 12. The square tube member 12 is shown in FIG. 5 from one side, and in FIG. 6 from an opposite side. With this construction, human-interface structures for a workout may attach to each of the vertical members 12-18 by interaction with the material defining one or more of the holes 10.

Figure 11:
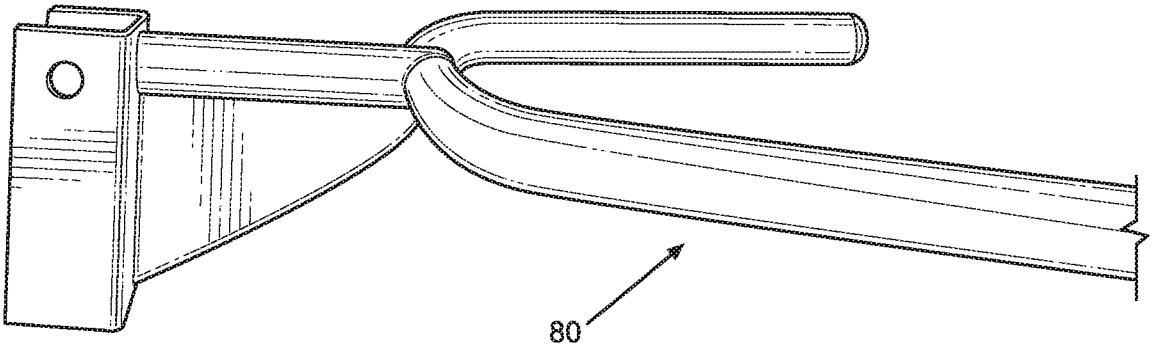
FIG. 11 is a view in perspective illustrating an exemplary human-interface, which is a dip bar.
Figure 12:
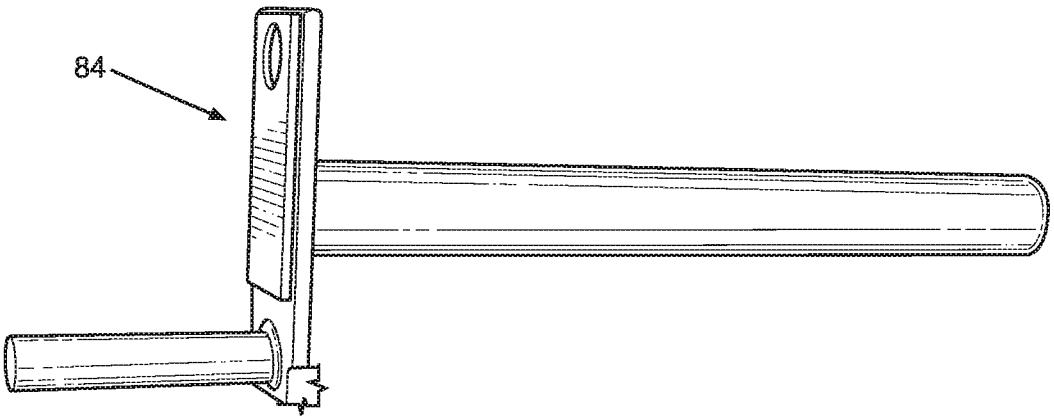
FIG. 12 is a view in perspective illustrating another human-interface, which is a handle.
Figure 13:
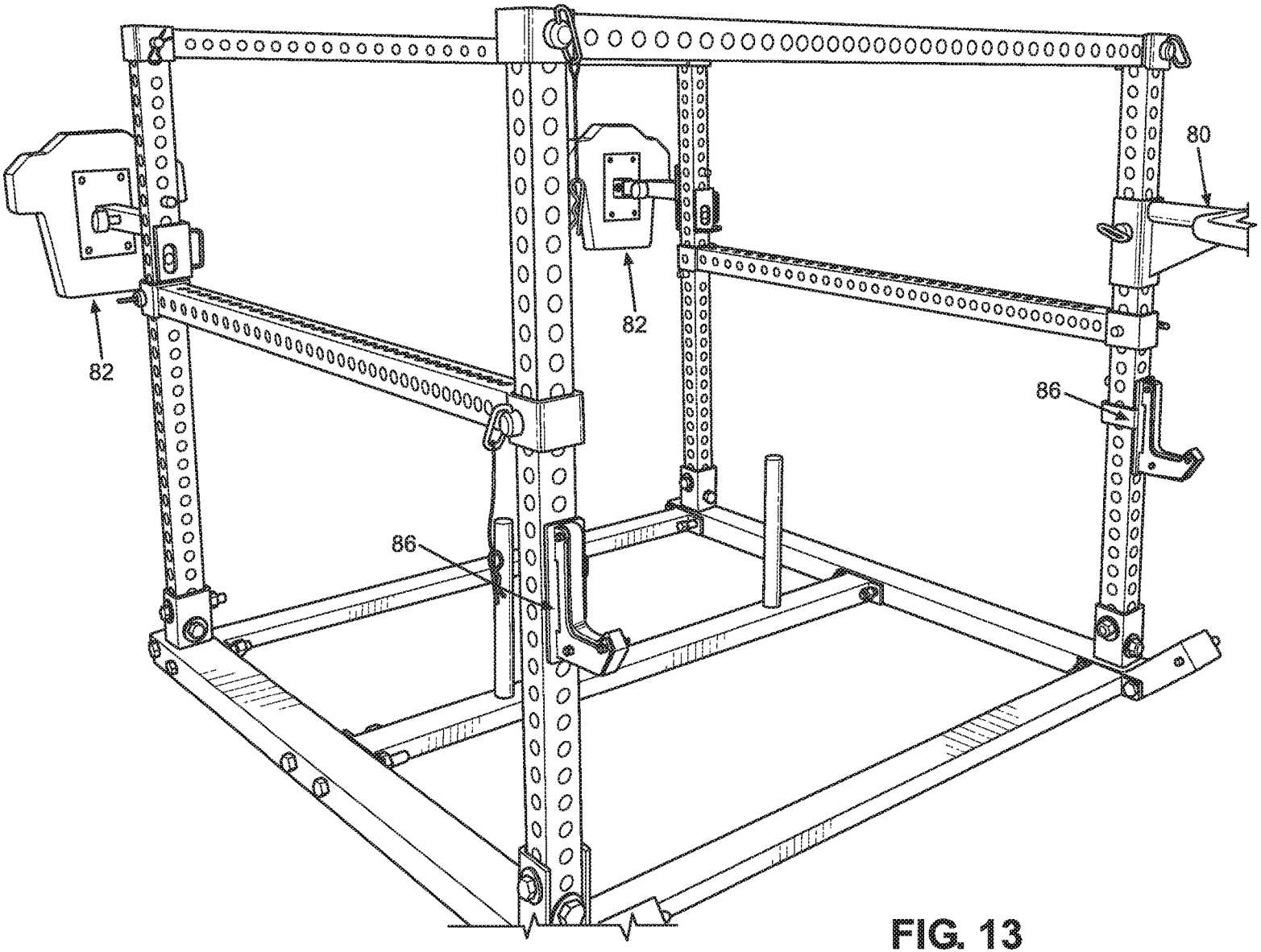
FIG. 13 is a view in perspective illustrating an alternative embodiment of the present invention.

In one embodiment, a pin 40 or a bolt may be extended through one or a pair of aligned holes to attach a human-interface workout structure to one of the vertical members. Such a pin or bolt may extend through aligned holes in the parallel legs of a U-shaped structure that are disposed on opposing sides of the vertical member, and through the aligned holes 10 in the vertical member. Each attached human-interface workout structure may be positioned at any point along the length of the vertical member, and then be fixed in position where desired by inserting a pin or bolt through the aligned holes. For example, human-interface workout structures may include a dip bar 80 (FIGS. 11 and 13), a striking product 82 (FIG. 13, which may be the apparatus disclosed in U.S. Application Ser. No. 15/212,764, which is incorporated herein by reference), a push bar 84 (FIG. 12), a barbell rest 86 (FIG. 13), or many other kinds of structures that may be attached wherever desired on the vertical members 12-18. Similar attachment may be made with the holes in the intermediate members 42-48.

It will be understood that the combination of the holes 10 into which a pin 40 may be inserted and/or around which collars and/or U-shaped structures may be extended can be replaced by a plurality of different attachment and/or fastening structures that suitably mount a human-interface to vertical, horizontal or other members of the apparatus 8. There are various fastening configurations known in the art that permit workout and weightlifting equipment to be attached to support structures such as the members of the apparatus 8. All of these fastening configurations are contemplated for the present invention. These fastening configurations include, but are not limited to, straight slots, angled slots, L-shaped slots, and structures (and combinations of structures) that are attached into these voids and cooperate with the surfaces that define such voids.

As shown in FIG. 1, the horizontally-oriented intermediate members 42-48 may have holes formed in all sides and substantially the entire length, similar to the vertically-oriented members 12-18. The horizontally-oriented intermediate members 42-48 may have U-shaped sockets on their ends that attach to the vertical members by surrounding the vertical members on three sides and then a pin may be extended through the two legs of the U-shaped socket. An alternative to the U-shaped sockets may be a collar on the ends of each of the horizontally-oriented intermediate members 42-48 that extend entirely around the vertical members 12-18. Thus, when the user seeks to move the horizontally-oriented intermediate member, he or she merely removes a pin out of each of the U-shaped members or collars. When using U-shaped sockets, the user may pull the entire horizontally-oriented intermediate member off of the apparatus 8 and then move the intermediate member to the location desired. When using collars, the user may slide the intermediate member up or down the vertical members to the location desired. In both examples, the user then inserts the pins in aligned holes in each opposite end of the collars or U-shaped members. Thus, the vertical members may support the intermediate horizontal members at any vertical position where there are apertures 10 through which a pin 40 may be inserted, or any other fastener structure may be attached.

In a preferred embodiment, the apparatus 8 is assembled in a manner that permits disassembly in a reasonably short time. This enables the apparatus 8 to be used in one location and then rapidly disassembled and stored or moved to another location. In one embodiment, the opposing ends of the vertically-oriented members 12-18 are fastened to the horizontally-oriented base members and ceiling members using one or more bolts at each end. Thus, removal of these bolts permits the vertically-oriented members to be removed from the base members and the ceiling members. Then the horizontally-oriented base members may be separated from one another by removing one or more bolts at each corner junction, and the horizontally-oriented ceiling members may be removed from one another by removing one or more bolts at each corner junction. The details of the preferred corner junctions will now be explained, although the person of ordinary skill will understand that many other fasteners and fastening mechanisms may be used in place of the preferred corner junctions and fasteners.

Figure 3:
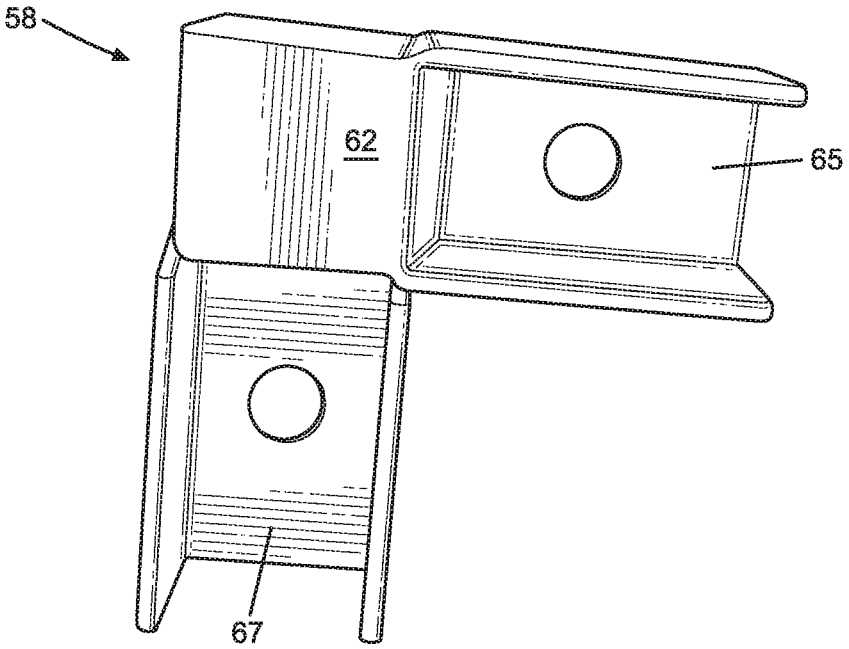
FIG. 3 is a top view illustrating a corner component embodiment used to join members of the apparatus together.
Figure 4:
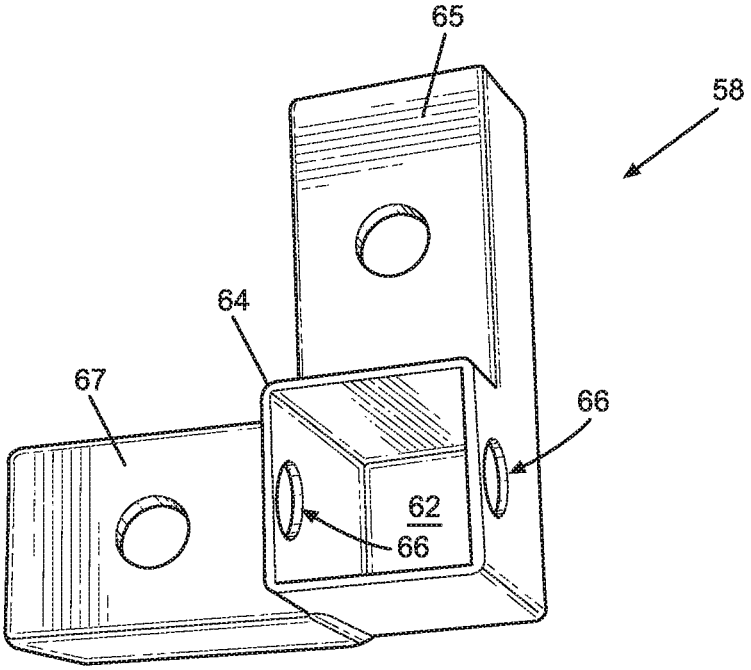
FIG. 4 is a view in perspective illustrating the corner component of FIG. 3.

The horizontally-oriented ceiling members 32-38 are mounted at their opposite ends to corner sockets, an exemplary embodiment of which is the corner socket 58 shown in FIGS. 3 and 4 from opposite sides. The corner socket 58 may mount to the top end of the vertically-oriented member 18, as shown in FIG. 1, and there may be three substantially identical corner sockets 52, 54 and 56 mounted to the tops of the other vertically-oriented members 12-16, respectively. The corner socket 58 may have a rectangular tube 62 with a sidewall 64 that defines an opening into which the upper end of the vertically-oriented member 18 inserts. A pair of aligned apertures 66 extends through the sidewall 64 and aligns with apertures 10 at the top of the vertically-oriented member 18 shown in FIGS. 5 and 6. A bolt, pin 40 or other fastener is extended therethrough to fasten the corner socket 58 to the vertically-oriented member 18.

The U-shaped channels 65 and 67 mount rigidly to the sidewall 64 of the tube 62 to form an L-shaped structure when viewed from the top. FIG. 3 shows the corner socket 58 from the top, and the channels 65 and 67 are shown with their channels open toward the top. The channels 65 and 67 receive the ends of the horizontally-oriented ceiling members 36 and 38, as shown in FIG. 1, and an aperture at the bottom of each channel 65 and 67 receives a fastener, such as a bolt, a pin 40 or another fastener that extends through apertures 10 in the ends of the horizontally-oriented ceiling members 36 and 38. Using the corner sockets 52-58 mounted to the tops of the vertically-oriented members 12-18, the horizontally-oriented ceiling members 32-38 are mounted at their ends at the upper ends of the vertically-oriented members 12-18 all around the apparatus 8.

The horizontally-oriented ceiling members 32-38 each have four holes, one on each side, in each end spaced the same distance from the closest end. Thus, each of the horizontally-oriented ceiling members 32-38 is rotatable about the longitudinal axis at 90 degree intervals in either direction from the position shown, and the fastener may be extended through the apertures 10 aligned with the aperture at the bottom of the respective channel. A user may thus take the ends of one of the horizontally-oriented ceiling members 32-38 out of their respective channels, rotate the member 90 or 180 degrees either direction, and then return the ceiling member back in the respective channels and put the fastener back in to lock the member to the corner socket.

The removal and rotation of the ceiling members permits a user to have different structural features on each of the four sides of each of the ceiling members. Thus, a user may rotate one of the horizontally-oriented ceiling members 32-38 around its longitudinal axis to expose one of these structural features for use. To do so, one need merely remove the associated fasteners at the ends of the ceiling member, raise the member's opposite ends out of the respective channels, rotate the member, and then place the member back into the associated channels in the orientation desired. Then the same fasteners may be used to mount the ceiling member to the respective corner sockets. This permits the horizontally-oriented ceiling members 32-38 to have a variety of structures, such as pull-up bars, pins, apertures and other features on their different sides, thereby permitting a user to simply rotate the respective one or more of the horizontally-oriented ceiling members 32-38 about its axis to make the feature usable. In one embodiment, the ceiling members 32-38 have on one side a connector to which the vertical bars of a squat rack attach. Thus, the apparatus 8 may support a squat rack, and even provide one or more vertical or horizontal members thereof. In this manner, the cost of adding a squat rack structure may be substantially less than that of a free-standing squat rack, and the stability that the apparatus 8 provides is substantial.

It will become apparent that corner sockets may be made that have an additional channel to receive an additional ceiling member. Such corner sockets are T-shaped when viewed from the top, rather than L-shaped as with the corner socket 58. Such T-shaped sockets permit one to mount another ceiling member to the associated vertical member, as is discussed in more detail below in association with adding components of another apparatus 108.

Figure 8:
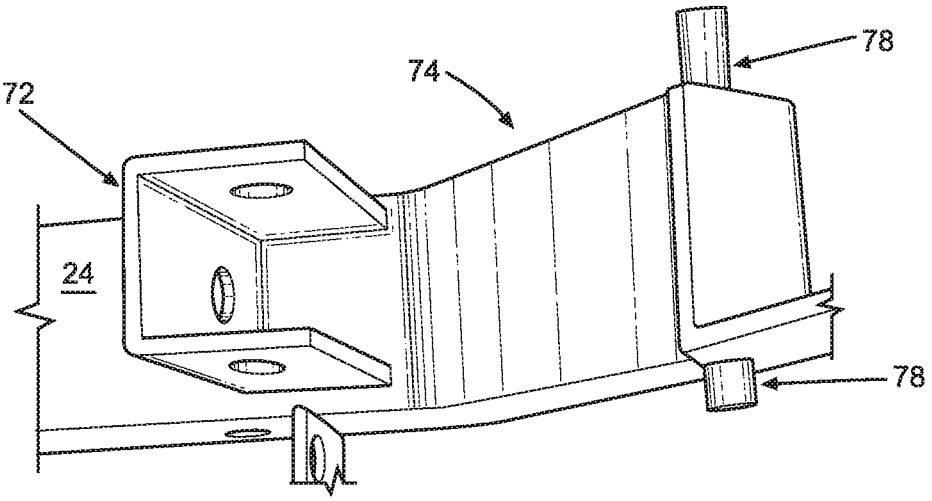
FIG. 8 is an elevation view in perspective illustrating the top of a member.
Figure 9:
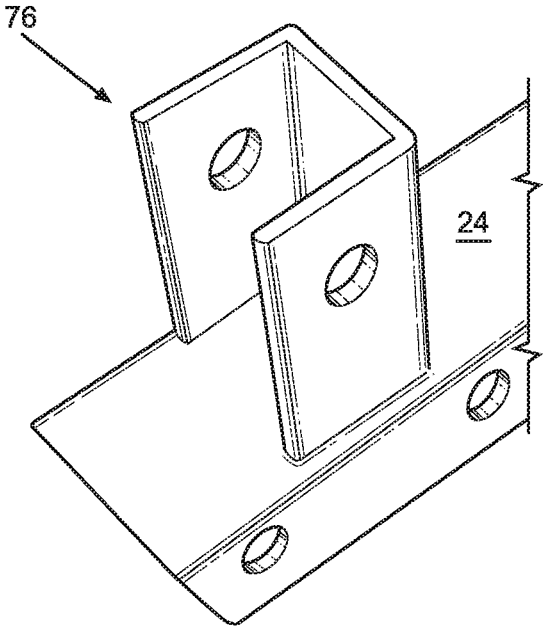
FIG. 9 is a side view in perspective illustrating an opposite end of the member of FIG. 8.

The lower ends of the vertically-oriented members 12-18 may be mounted to the horizontally-oriented base members 24 and 28. Channels 72 and 76 are mounted to the upwardly-facing sides of the base member 24 (near opposite ends) as shown in FIGS. 8 and 9. The base member 24 is described as an example, and the member 28 is identical to, or may be a mirror image of, the member 24. The first channel 72 is formed near a front end of the member 24, and this front end preferably has an upwardly angled portion 74, which may be disposed at an angle of 30-60 degrees from the longitudinal axis of the member 24. The upwardly angled portion 74 is visible in FIG. 1, and it will become apparent that this feature gives the member 24 an upturned end, in the manner of a ski, so the apparatus 8 may be slid along the ground without becoming caught on obstacles. The second channel 76 is mounted near the opposite end of the member 24, which has a straight end, but which may have an upturned end as an alternative. An axle 78 may be transverse, and preferably perpendicular, to the longitudinal axis of the member 24, and pass through the upwardly angled portion 74 of the base member 24. This axle is explained in more detail below.

Attachment of the lower ends of the vertically-oriented members 12-18 to the members 24 and 28 is similar to attachment of the horizontally-oriented ceiling members to the channels 65 and 67 of the socket 58. The lower ends of the vertically-oriented members 12-18 are inserted into the voids in the channels 72 and 76 (and their similar channels in the member 28), and apertures 10 in the lower ends of the vertically-oriented members 12-18 are aligned with the apertures in the channels 72 and 76. Pins, bolts or other fasteners may be extended through the aligned apertures to rigidly fix the vertically-oriented members 12-18 to the base members 24 and 28.

Figure 10:
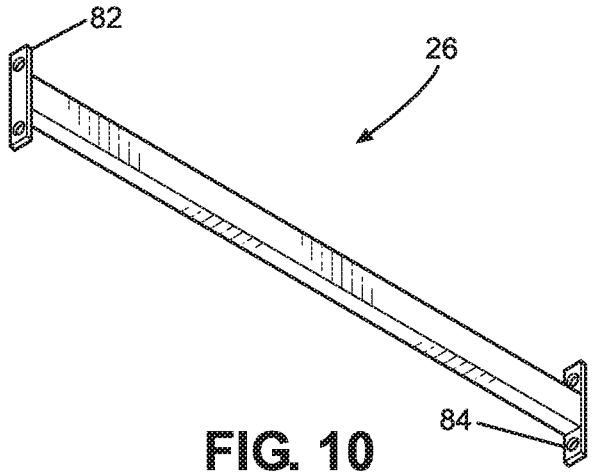
FIG. 10 is a view in perspective illustrating a member.
Figure 14:
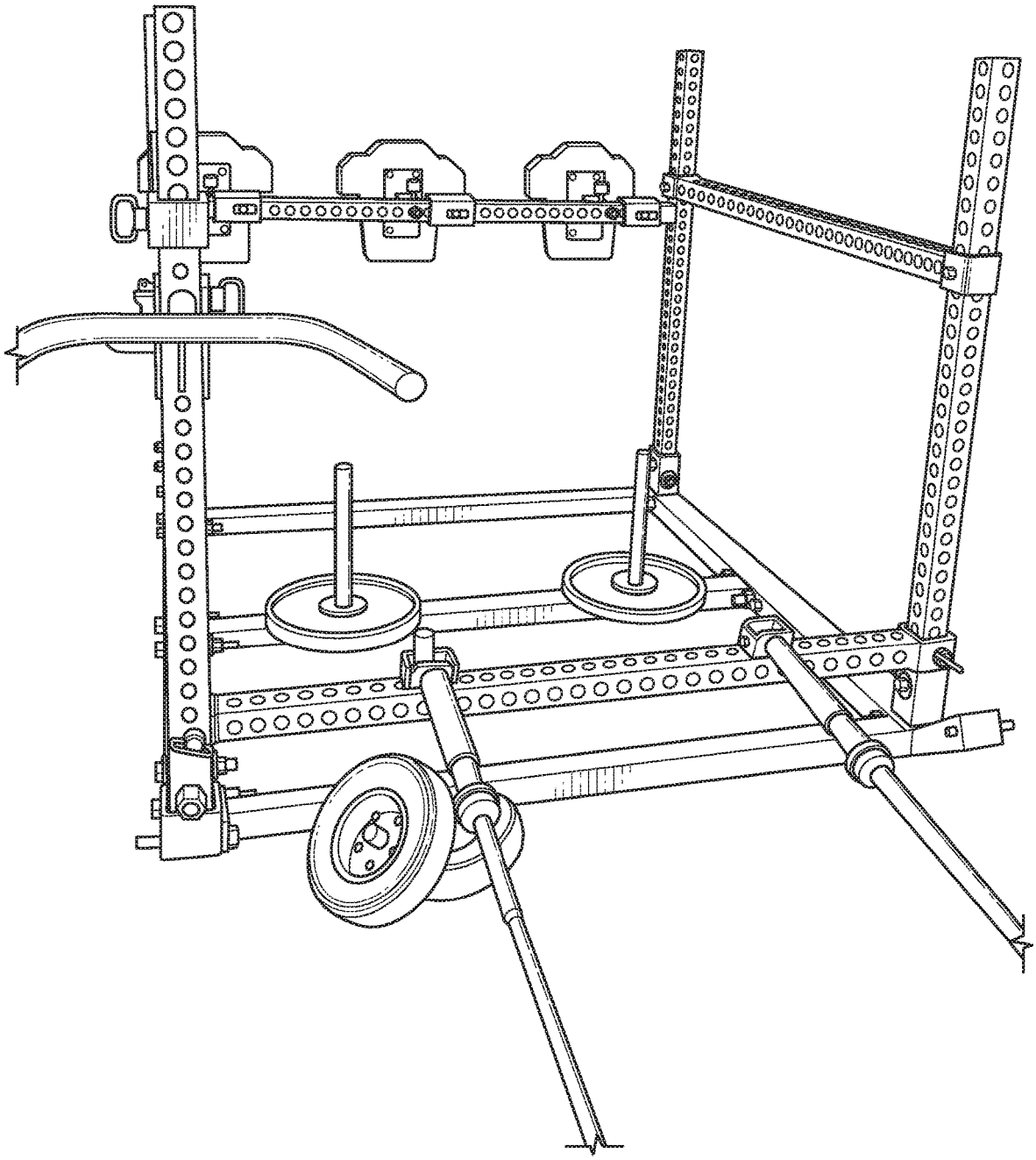
FIG. 14 is a view in perspective illustrating an alternative embodiment of the present invention.

The four vertical members 12-18 and the members 24 and 28 do not move substantially relative to one another once they are attached, even when the apparatus 8 is in use. When the vertical members are bolted into place on the members 24 and 28, which are substantially parallel to one another, they stay in that configuration throughout the entire time that the apparatus 8 is used. The members 22 and 26, which are transverse to the members 24 and 28, may fasten to the members 24 and 28 at opposite ends. The member 26 is shown in FIG. 10 having flanges 82 and 84 fixed at opposite ends. The member 22 is identical to, or a mirror image of, the member 26 shown. The flanges 82 and 84 have apertures through which bolts may extend, and then through aligned apertures in the members 24 and 28, for fixing the members 22 and 26 to the members 24 and 28 as shown in FIG. 1, thereby forming a polygon, such as a rectangle. A cross member 25, which may be similar to the members 22 and 26, but with the addition of one or more transverse posts 25*a* and 25*b*, may extend between the members 24 and 28. The transverse posts 25*a* and 25*b* may receive weight plates through the apertures in the center of the plates for causing the apparatus 8 to have greater mass, for example when the apparatus 8 is used as a sled or when movement of the apparatus 8 relative to the ground is not desired, or simply for storage of the weight plates. This is illustrated in FIG. 14.

The base members 24 and 28 may have wheels mounted on the axles 78 formed thereon at only one end of the apparatus 8. In the configuration shown in FIG. 1, the wheels may be mounted at the ends of the members 24 and 28 that are upturned or angled away from the surface upon which the apparatus 8 rests, thereby permitting the apparatus 8 to function as a trailer when the wheels engage the surface. Thus, one end has wheels engaged with the ground and the other end may be raised and pushed or pulled to roll the apparatus along the ground on the wheels only in the manner of a wheelbarrow. In this configuration, the apparatus 8 may alternatively be pushed as an exercise device while the wheels engage the ground at one end, and the members 24 and 28 engage the ground at the opposite end. In this configuration, the apparatus 8 acts somewhat as a sled. Alternatively, the wheels may not be in contact with the ground until the opposite end is raised, thereby contacting the ground with the wheels and raising the members 24 and 28 entirely off of the ground. Then the apparatus 8 may be moved along the ground by rolling on the wheels only, and it may be moved along the ground as a sled with the wheels raised off the ground.

Figure 16:
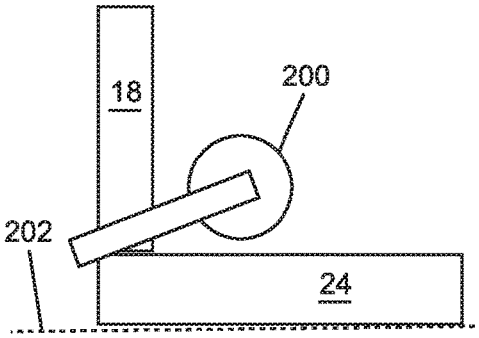
FIG. 16 is a schematic illustrating a wheel-engagement unit in side view in a ground-lifted configuration.
Figure 17:
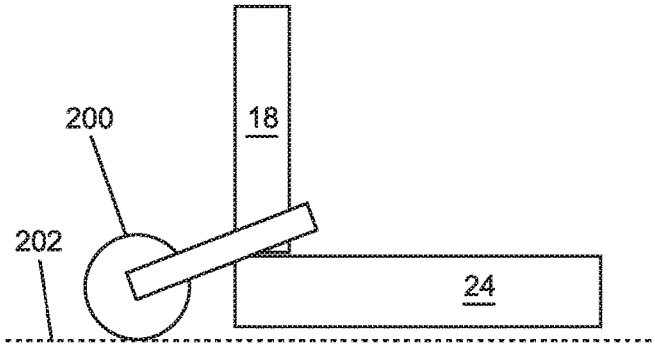
FIG. 17 is a schematic illustrating the wheel-engagement unit of FIG. 16 in a ground-engaging configuration.

In another embodiment, the members 24 and 28 contact the ground at all times, and wheels are not mounted to a stationary axle 78, but are mounted to axles that may be moved between at least two positions. The wheels may be located on one end of the apparatus 8 only, at both, opposite, ends, at or near all corners, or in any other suitable configuration. In one embodiment shown schematically in FIGS. 16 and 17, a mechanism to which a wheel 200 is mounted may be disposed at or near each of the four corners of the apparatus 8. These mechanisms may move the wheels' axles, and therefore the contact surfaces of the wheels, in and out of two positions. The first position is a ground-engaged position, shown in FIG. 17, in which the wheel 200 is in contact with the ground 202 and the members 24 and 28 do not rest on the ground. In the second position, which is the ground-lifted position shown in FIG. 16, the wheel 200 is not engaged with the ground and the base members 24 and 28 engage the ground. When the wheels are engaged with the ground 202, the entire apparatus 8 may be rolled like a wagon or trailer on the wheels 200. When the wheels are not engaged with the ground 202, the entire apparatus 8 may be moved by being pushed like a sled. In this configuration, the base members 24 and 28 engage the ground and the apparatus 8 slides on the surface of the ground in the manner of a sled where the base members 24 and 28 function in the manner of skis. This configuration is in order to permit athletes, such as football players, to strike the striking surfaces or lift the bars, and move the apparatus 8 in the manner of a blocking sled. It is contemplated to engage two of the four wheels with the ground to make the apparatus 8 more difficult to move than when no wheels are engaged, but not as easy as when all four wheels are engaged. Of course, it is contemplated to engage one, two, three or all four wheels. Furthermore, more than four wheels may be used.

In the embodiment, the user would typically engage all four wheels when the apparatus 8 simply needs to be moved from one location to another and disassembly is not desired. In this configuration, the user is not necessarily exercising and the apparatus may be pulled like a trailer by a tractor or other vehicle. The user may alternatively engage two wheels when he or she is exercising to some degree, but does not desire to push the apparatus 8 like a blocking sled. And there is a third configuration in which none of the wheels is engaged with the ground, and one or more athletes move the apparatus 8 like a sled. This last position with no wheels engaged is the configuration for when no movement of the apparatus 8 is desired, such as when the structures mounted to the apparatus 8 are being used, such as the dip bars, the rotatable barbells, etc. In this stationary configuration, the athletes use the apparatus 8 as a support for exercise. In this configuration, it may be that no horizontal or lateral force is being exerted against the apparatus 8, but if a lateral force is applied, numerous weight plates may be added to the base members to prevent movement of the apparatus 8.

It is contemplated that the mechanisms to move the wheels into or out of engagement with the ground may be pneumatically, hydraulically, mechanically or otherwise actuated so that human strength is not required to raise the apparatus 8 off of the ground (where the contact surface of each wheel is below the bottom of each skid). Alternatively, a foot may be used to pivot the wheel from inside the perimeter formed by the base members where the wheel is not engaged with the ground to a position outside the perimeter where the wheel engages the ground and lifts the nearby portion of the apparatus 8 above the ground. A pin may then be inserted to lock the mechanism in place. It is also contemplated that the wheel mechanisms may be removable, such as how a trailer hitch is removable from a receiver mounted to a vehicle. A receiver may be welded to the vertical or base members to receive a mechanism with a wheel and axle thereon. Upon raising the apparatus 8 slightly, the mechanism with the wheel and axle is inserted into the receiver and a hitch pin is inserted to lock the mechanism in place. It is contemplated to engage the ground with only the wheels on one side of the apparatus 8 so that athletes may use handles to raise the opposite side during exercise, and push the apparatus 8 along the ground.

The four vertical members 12-18 have holes 10 for human-interface workout attachments to be mounted at any position where there is a hole 10. Alternatively, the user may mount the intermediate members 42-48 at a hole of a vertical member, which intermediate members 42-48 are vertically adjustable and may hold striking pads and other human-interface workout structures. Another embodiment of the invention has striking surfaces attached to the vertical members 12-18 or the intermediate members 42-48 that permit use when on ice (for hockey players to strike as a hockey player would strike an opponent), on a basketball court (for a basketball player to strike, such as during a "boxing out" move), and on a lacrosse field (for a lacrosse player to strike when holding a lacrosse stick).

Figure 15:
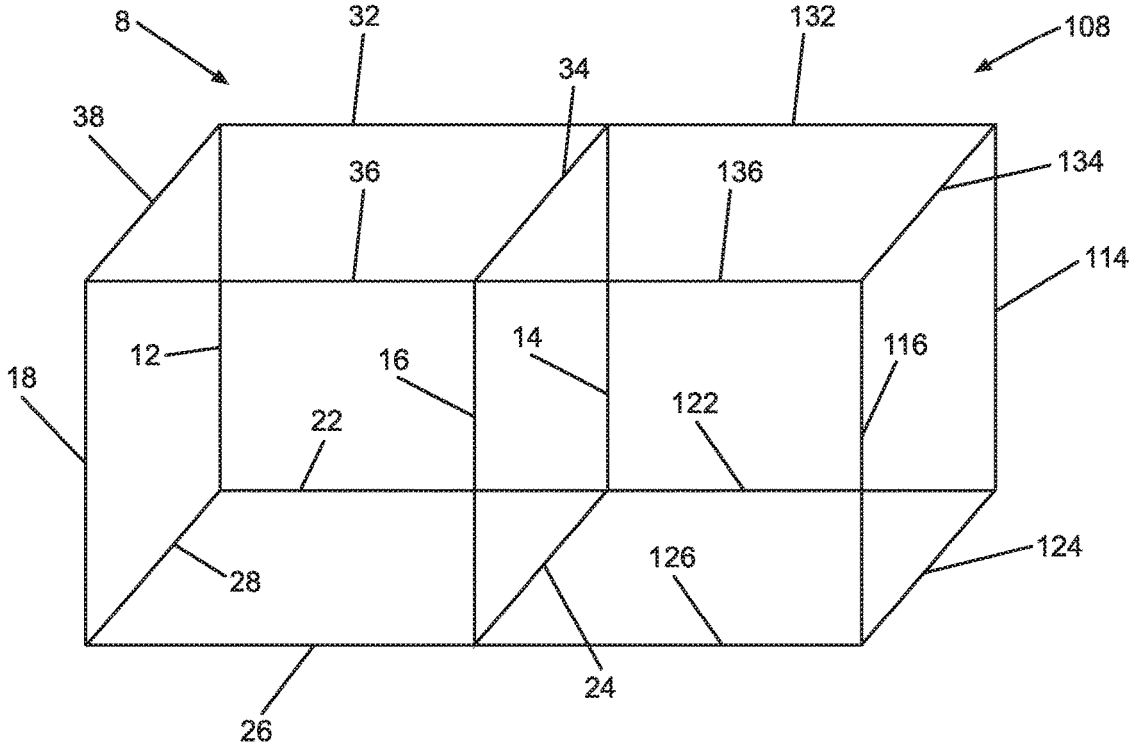
FIG. 15 is a view in perspective illustrating an alternative embodiment of the present invention.

In one embodiment, the holes through the base members 24 and 28 permit a second base member 124 (which may be identical to the base member 24), and third and more base members, to be mounted substantially parallel to the base members 24 and 28 as shown in the schematic illustration of FIG. 15. This is accomplished by extending two or more base members 122 and 126 (which are identical to the base member 26) perpendicular to the base member 24. This configuration preferably uses the same bolts used to mount the base members 22 and 26 to the base member 24 by extending the bolts through the flanges on the base members 122 and 126. The base members 122 and 126 mount to the sides of the base member 124. Thus, the base member 124 is parallel to the member 24 and is spaced the same distance from the base member 24 as the base member 28. This forms a laterally-oriented second apparatus 108 adjacent and connected to the apparatus 8.

Two vertical members 114 and 116 are mounted at their bottom ends to the base member 124 in the same manner that the vertical members 12-18 are mounted to the base members 24 and 28. The L-shaped corner sockets on the tops of the vertical members 14 and 16 are replaced with T-shaped sockets as described above. For example, the top of the vertical member 16 extends into the square tube of the new socket and the channels extend laterally to receive the ceiling members 34, 36 and 136. L-shaped sockets similar to the socket 58 are moved to the vertical members 114 and 116 and receive the ceiling members 132, 134 and 136. Thus, the apparatus 8 can have one or more apparatuses 108 mounted adjacent thereto in order to expand the apparatus 8 as much as desired.

In an embodiment shown in FIGS. 18-21, the apparatus 208 has four substantially-vertical members 212, 214, 216 and 218 mounted at their lower ends to the horizontal members 224 and 228. The vertical members 212-218 may be attached to the horizontal members 224 and 228 by bolts, pins, rivets, weldments, or any other suitable fastener. In a preferred embodiment, the vertical members 212-218 are attached to the horizontal members 224 and 228 by removable fasteners to permit the apparatus 208 to be disassembled. The horizontal members 222 and 226 mount at opposite ends to the horizontal members 224 and 228, which serve as skids upon which the weight of the rest of the apparatus 208 rests. Upwardly curved ends of the horizontal members 224 (e.g., 224*e*) and 228 permit the members to slide along their longitudinal dimension, which extends along a line parallel to the members 224 and 228. Four wheels 282, 284, 286 and 288 are mounted to the base polygon, which is made up of the members 222, 224, 226 and 228 rigidly attached together to form a base polygon, which is a rectangular lower frame.

Figure 18:
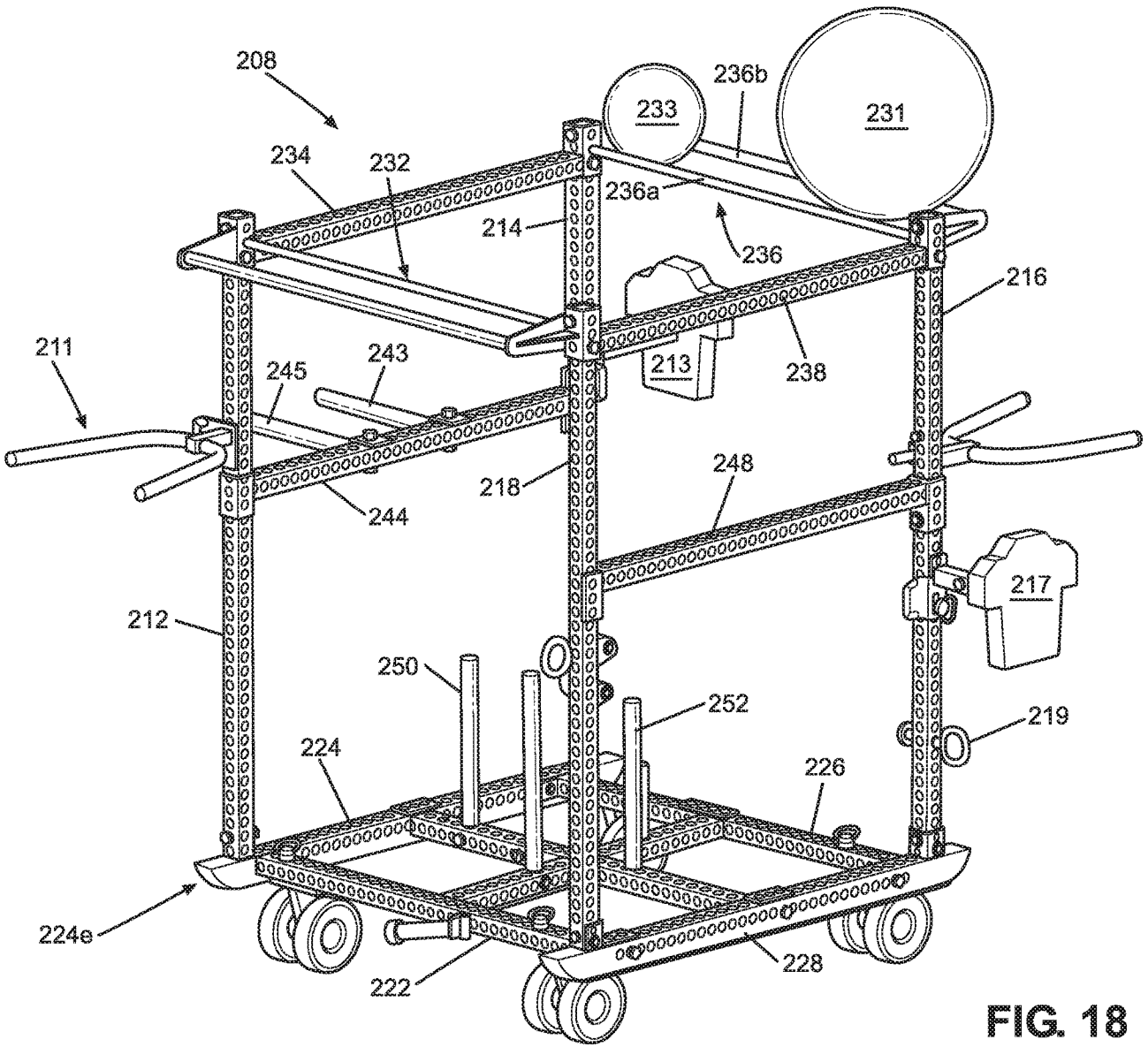
FIG. 18 is a view in perspective illustrating an alternative embodiment of the present invention.
Figure 19:
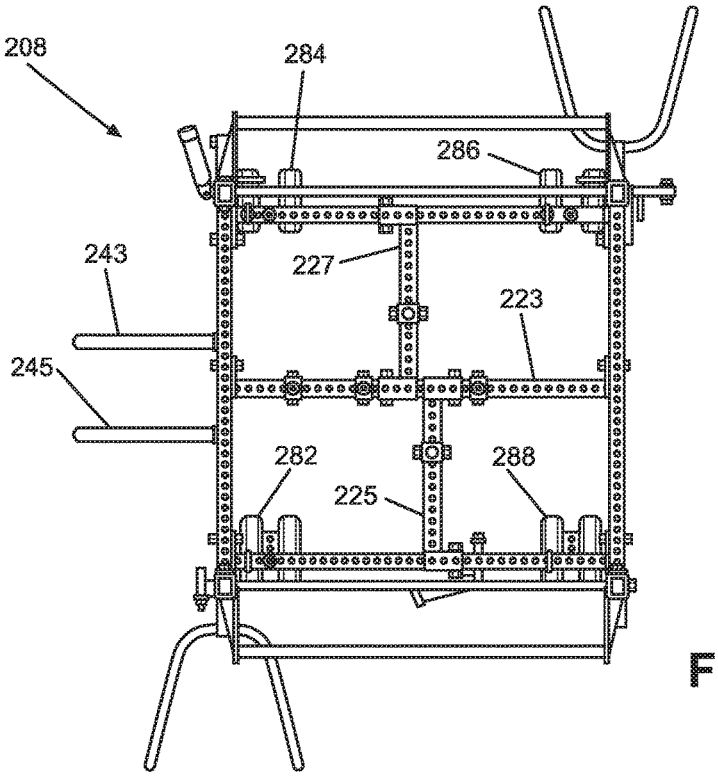
FIG. 19 is an elevation view illustrating the embodiment of FIG. 18.
Figure 20:
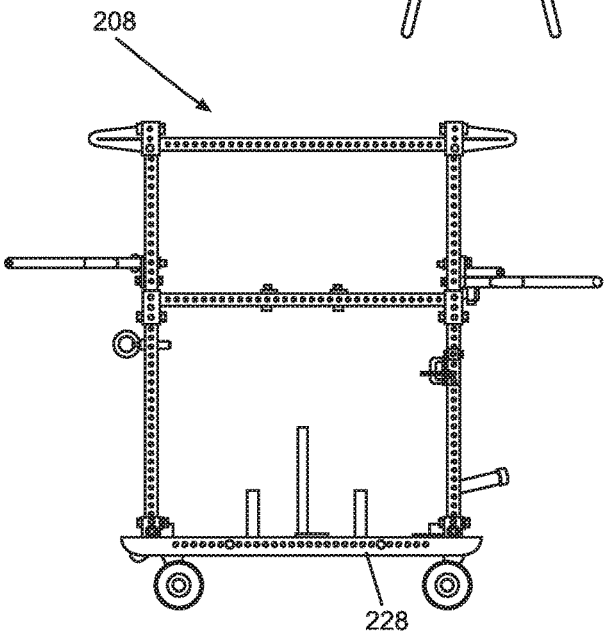
FIG. 20 is a side view illustrating the embodiment of FIG. 18.
Figure 21:
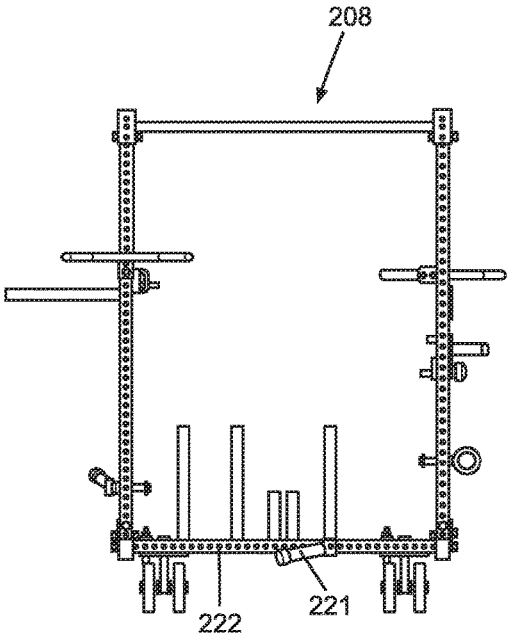
FIG. 21 is an end view illustrating the embodiment of FIG. 18.

The horizontal members 232, 234, 236 and 238 form a ceiling polygon, which is in the shape of a rectangle. Each of the members 232-238 mounts at or near its opposing ends to the vertical members 222-228 using fasteners, such as the removable or permanent fasteners described above. The members of the apparatus 208 may be hollow rectangular or circular cross-section beams with spaced apertures on some or all sides thereof. Alternatively, as shown in FIG. 18, each of the horizontal members 232 and 236 is made of a pair of parallel, non-perforated bars (e.g., 236*a* and 236*b*) that are mounted to plates at opposite ends and provide a storage location therebetween for one or more balls 231 and 233. Furthermore, the bar 236*b* may be a human-interface that may be used for chin-ups by a user grasping the same with his or her hands and pulling himself or herself upwardly. Other human interfaces shown in FIG. 18 include the dip bars 211 and 213 mounted to the vertical members 212 and 216, respectively. The high rotation bar attachment 221 permits a user to mount a weight bar thereto and pivot the bar upwardly after attaching weight plates to the weight bar. The rope ring 219 is another human interface that permits a user to mount a rope thereto. The striking surfaces 213 and 217 are human interfaces mounted to the vertical members 214 and 216, respectively, thereby permitting a user to strike the striking surfaces 213 and 217 with the hands, feet, shoulder or other body parts or articles, such as lacrosse sticks. Horizontal members 223, 225 and 227 attach to the members 222-228 and provide weight plate rods 250 and 252 for securing weight plates to the apparatus 208.

As described herein, the horizontally-oriented intermediate members 244 and 248 are removably mounted to the vertical members 222-228 so that the intermediate members 244 and 248 may be conveniently moved vertically to another position on the vertical members. This convenient movement permits any human interfaces mounted thereto to be moved, including the human-graspable handles 243 and 245.

If the wheels 282-288 are removed, the apparatus 208 may sit with the members 224 and 228 resting on a surface, such as grass or turf, and be pushed along the surface in the manner of a sled by a person pushing against the striking surface 213. The ends of the members 224 (e.g., 224*e*) and 228 are angled upwardly away from the surface to prevent the ends of the members 224 and 228 from digging into the surface and slowing movement. Thus, the upturned ends of the horizontal members serve as the leading edges of "skis" that the skids serve as during use as a sled. If the striking surface 217 is moved ninety degrees around the vertical member 216, another person may push on the striking surface 217 to assist the person pushing on the surface 213. In an alternative, the wheels 284 and 286 are removed and the wheels 282 and 288 are left in the position shown in FIG. 18 so that ends of the horizontal members 224 and 228 are resting on the surface, and opposite ends are raise above the surface by the wheels 282 and 288.

Another embodiment of the invention is shown in FIGS. 22-25, in which the apparatus 308 has four substantially-vertical members 312, 314, 316 and 318 mounted at their lower ends to the horizontal members 324 and 328. The vertical members 312-318 may be attached to the horizontal members 324 and 328 by bolts, pins, rivets, weldments, or any other suitable fastener. In a preferred embodiment, the vertical members 312-318 are attached to the horizontal members 324 and 328 by removable fasteners to permit the apparatus 308 to be disassembled. The horizontal members 322 and 326 mount at opposite ends to the horizontal members 324 and 328, which serve as skids upon which the weight of the rest of the apparatus 308 rests. Upwardly curved ends of the horizontal members 324 (e.g., 324*e*) and 328 permit the members to slide along their longitudinal dimension, which extends along a line parallel to the members 324 and 328. No wheels are shown mounted to the base polygon, which is made up of the members 322, 324, 326 and 328 rigidly attached together to form a rectangular lower frame. However, wheels are contemplated for attachment to the base polygon.

Figure 22:
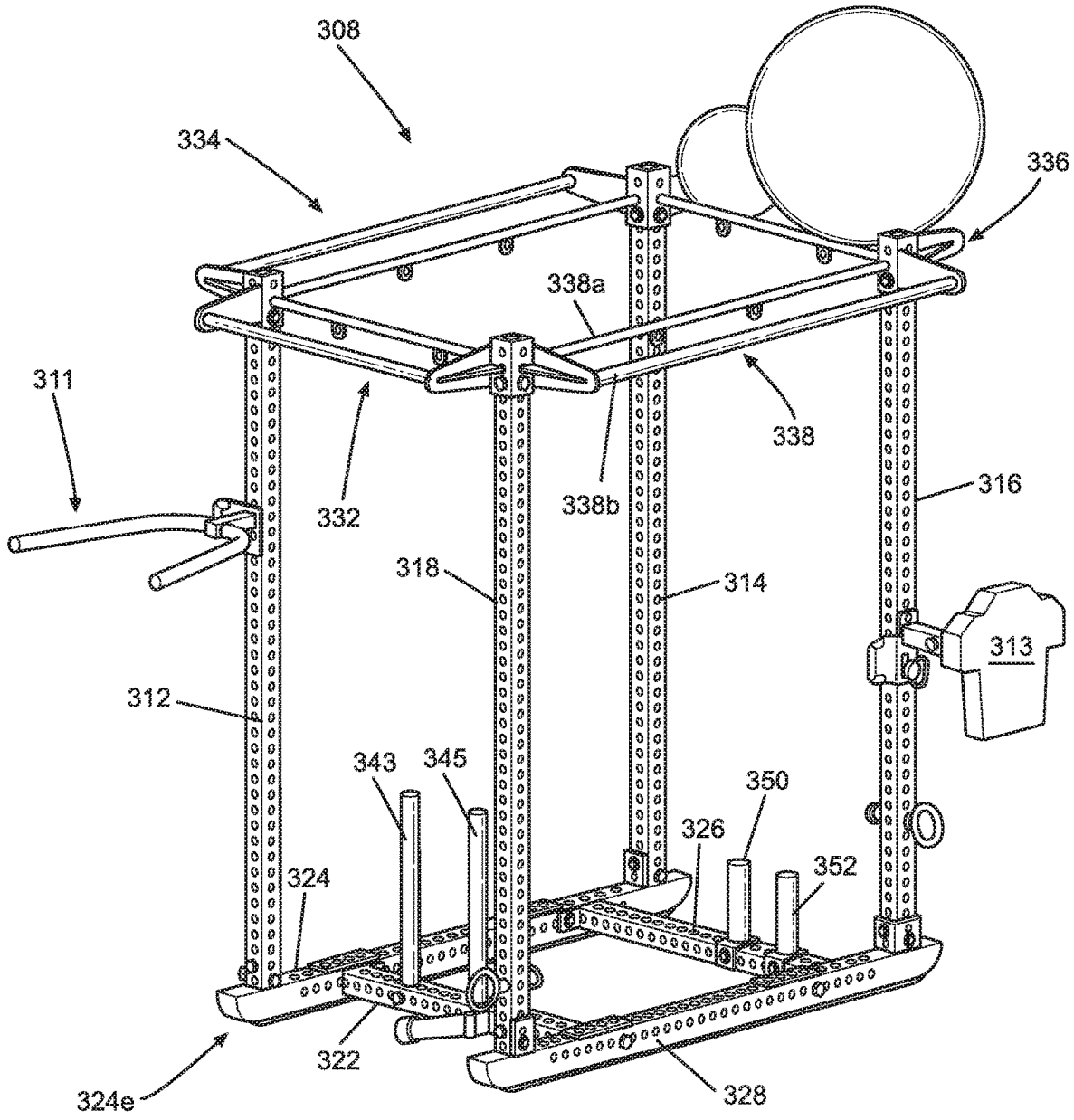
FIG. 22 is a view in perspective illustrating an alternative embodiment of the present invention.
Figure 23:
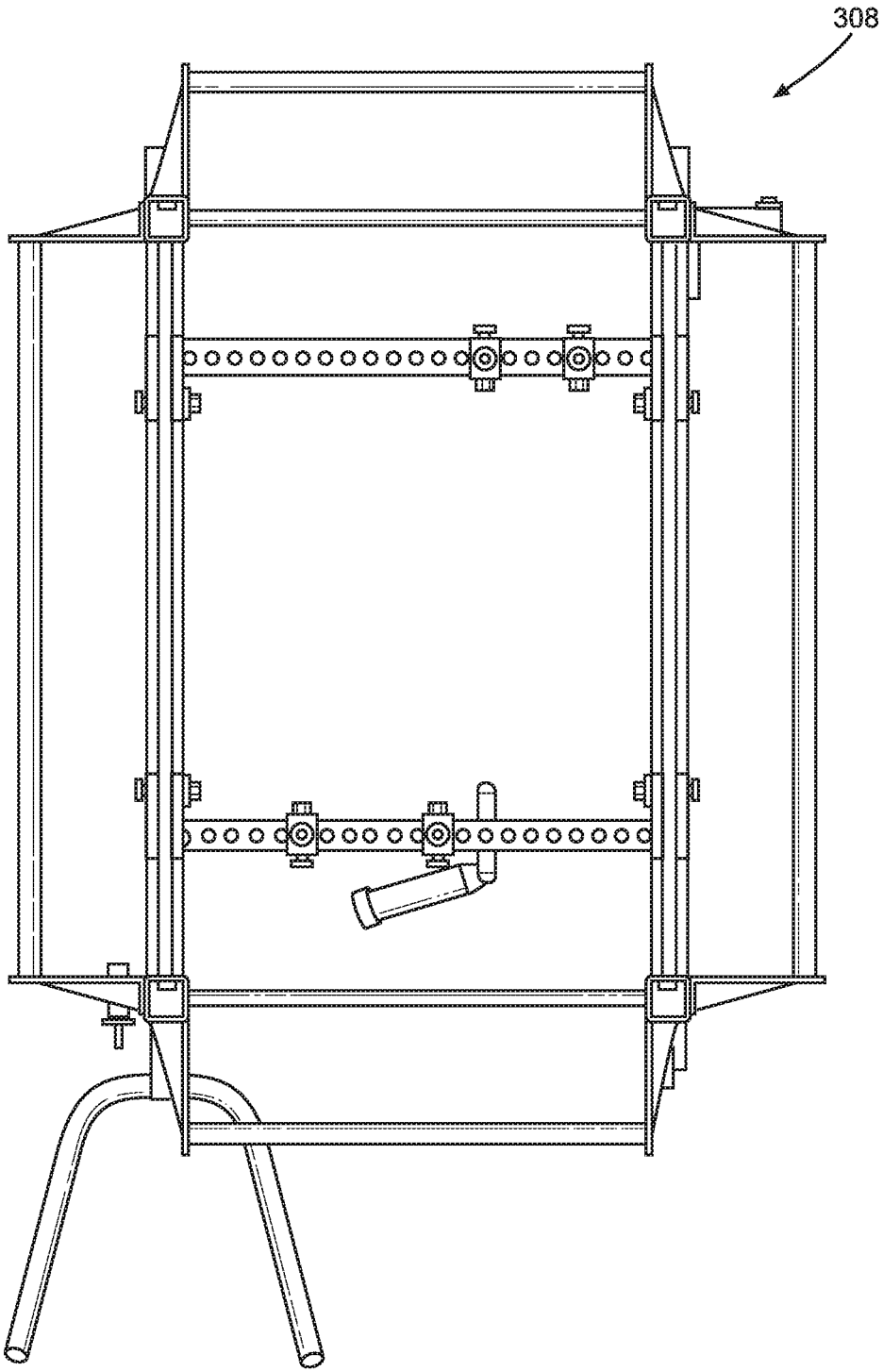
FIG. 23 is an elevation view illustrating the embodiment of FIG. 22.
Figure 25:
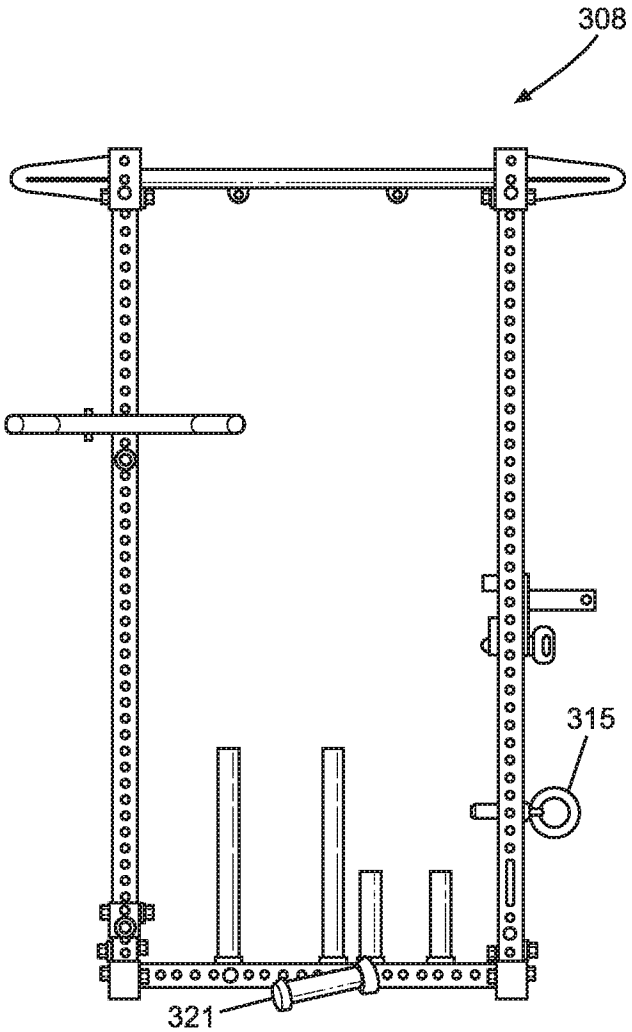
FIG. 25 is an end view illustrating the embodiment of FIG. 22.
Figure 24:
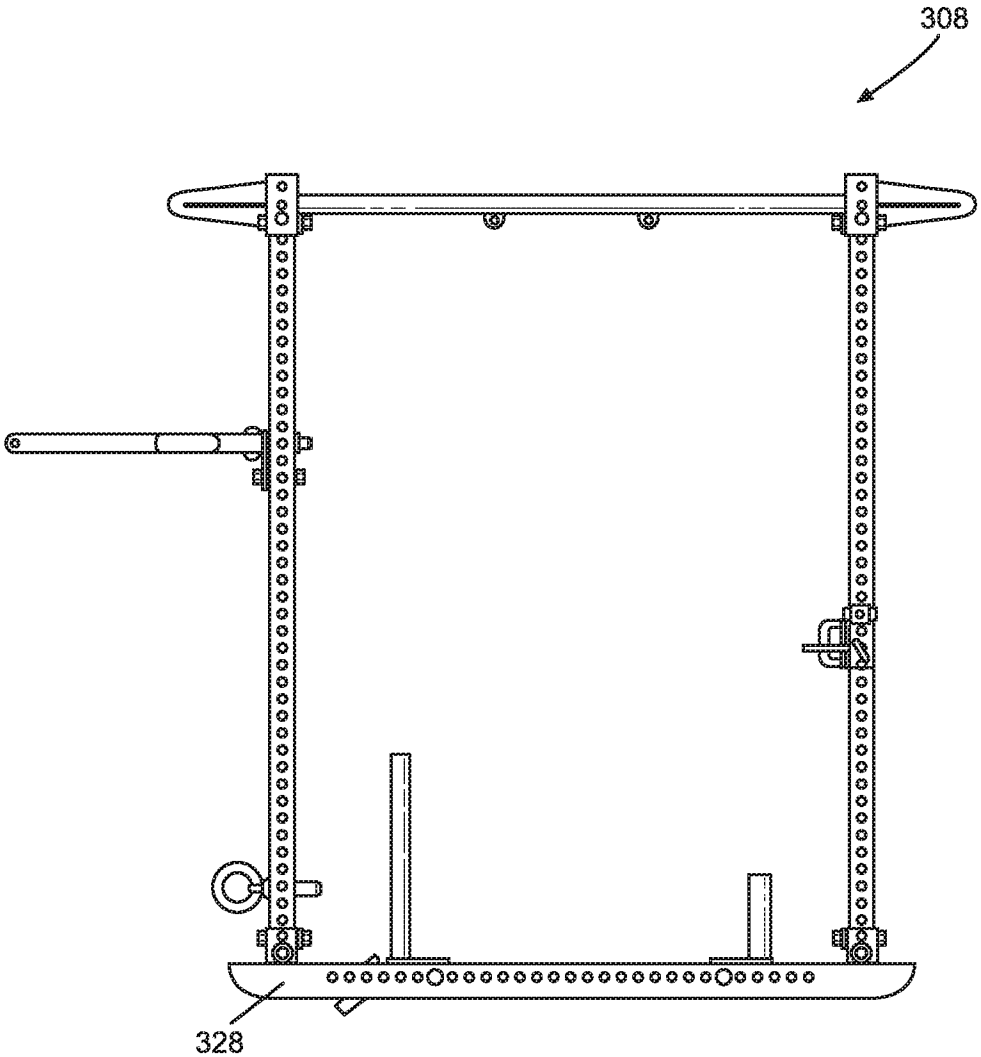
FIG. 24 is a side view illustrating the embodiment of FIG. 22.

The horizontal members 332, 334, 336 and 338 form a ceiling polygon, which is in the shape of a rectangle. Each of the members 332-338 mounts at or near its opposing ends to the vertical members 322-328 using fasteners, such as the removable or permanent fasteners described above. The members of the apparatus 308 may be hollow rectangular or circular cross-section beams with spaced apertures on some or all sides thereof. Alternatively, as shown in FIG. 22, each of the horizontal members 332-338 is made of a pair of parallel, non-perforated bars (e.g., 338*a* and 338*b*) that are mounted to plates at opposite ends and provide a storage location therebetween for one or more balls. Furthermore, the bar 338*b* may be a human-interface that may be used for chin-ups by a user grasping the same with his or her hands and pulling himself or herself upwardly. Other human interfaces shown in FIGS. 22-25 include the dip bars 311 mounted to the vertical member 312. The high rotation bar attachment 321 permits a user to mount a weight bar thereto and pivot the bar upwardly after attaching weight plates to the weight bar. The rope ring 315 is another human interface that permits a user to mount a rope thereto. The striking surface 313 is a human interface mounted to the vertical member 316, thereby permitting a user to strike the striking surface 313 with the hands, feet, shoulder or other body parts, or articles, such as hockey sticks. Weight plate rods 350 and 352 are mounted to the member 326 for securing weight plates to the apparatus 308.

Any of the human interfaces are preferably mounted to the apparatus 308 in such a manner that allows them to be moved, including the human-graspable handles 343 and 345 mounted to the member 322. The apparatus 308 may sit with the members 324 and 328 resting on a surface, such as grass or turf, and may be pushed along the surface in the manner of a sled by a person pushing against the handles 343 and 345. The ends of the members 324 (e.g., 324*e*) and 328 are angled upwardly away from the surface to prevent the ends of the members 324 and 328 from digging into the surface and slowing movement. Thus, the upturned ends of the horizontal members serve as the leading edges of skis. When all wheels are removed from the embodiment 308 as shown, the apparatus 308 may be used as a conventional squat rack to support barbells while stationary. This permits the apparatus 308 to serve as a weight rack or similar, and when it is desired to move the apparatus 308, one need merely attach wheels to the apparatus 308 and move it in the manner of a trailer. Thus, the apparatus 308 has at least two uses when no wheels are attached—stationary weight rack and sled, and at least two uses when at least two wheels are attached—trailer and sled. Such an apparatus may be used to transport weights and other exercise devices to a practice field, athletes may train on and with the apparatus, and then the same may be rolled back into a covered facility for protection from weather as needed. All of these uses are possible with an apparatus that has removable (or storable) wheels that can be in one of at least two positions.

Figure 26:
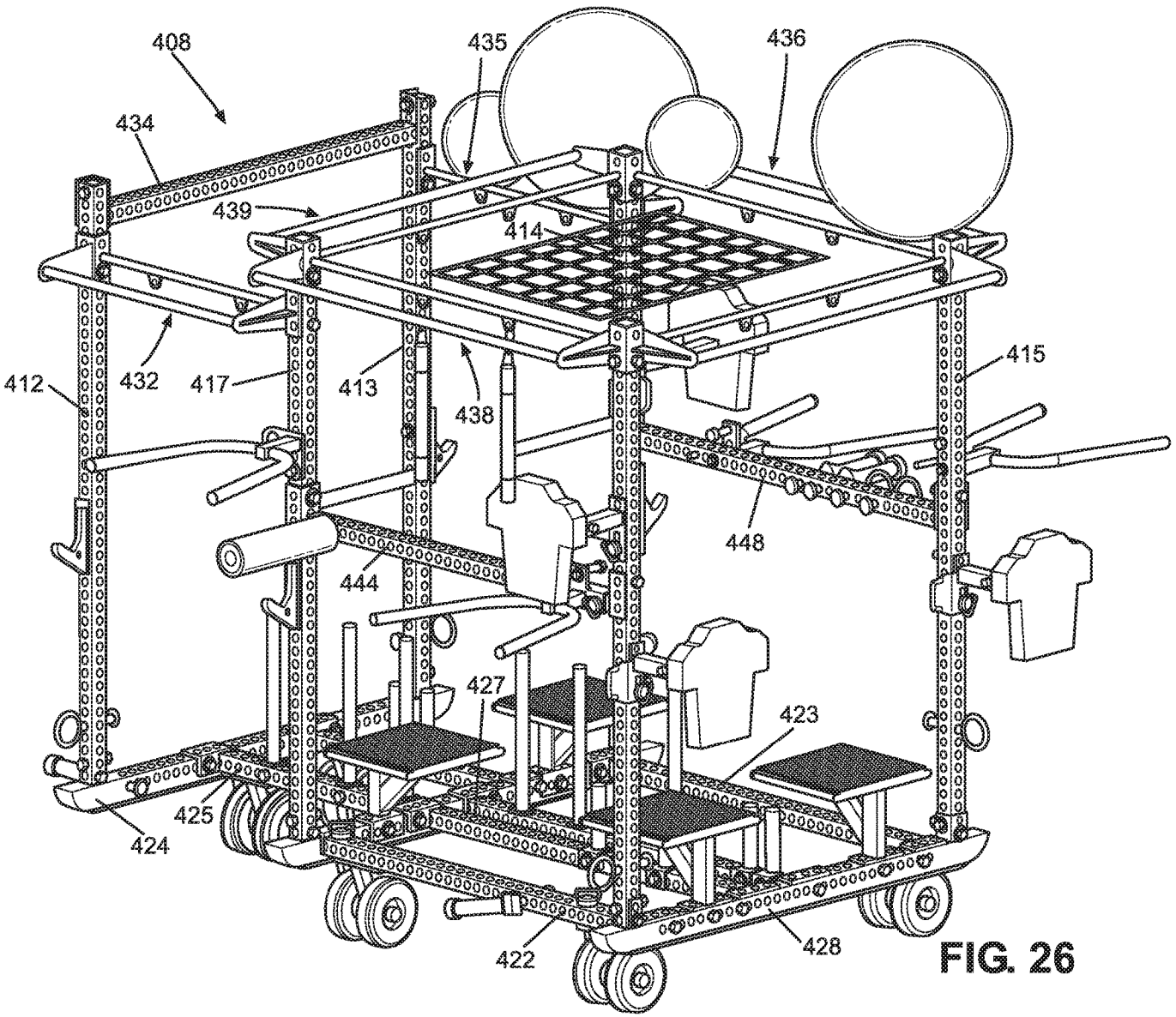
FIG. 26 is a view in perspective illustrating an alternative embodiment.

The apparatus 408 shown in FIG. 26 is another alternative. The apparatus 408 has six vertical members 412, 413, 414, 415, 416, and 417, each of which is attached at its lower end to the three horizontal members 424, 426 and 428, which are substantially parallel. The members 422, 423, 425 and 427 are mounted at their ends to the sides of the members 424, 426 and 428. A polygon ceiling is made up of the members 432, 434, 435, 436, 437, 438, and 439. As with the apparatus 208 and the apparatus 308, the apparatus 408 may have wheels mounted to the polygon base, which wheels may be removed or moved between at least two positions. A variety of human interfaces is mounted to the vertical members 412-417, and the vertically-moveable intermediate members 444-448. The members 412, 413, 424, 425, 427, 432, 434, and 435 may be considered an adjunct to the remainder of the members of the apparatus 408, and may be removable from the members 417, 426 and 414 to form a smaller device.

Figure 27:
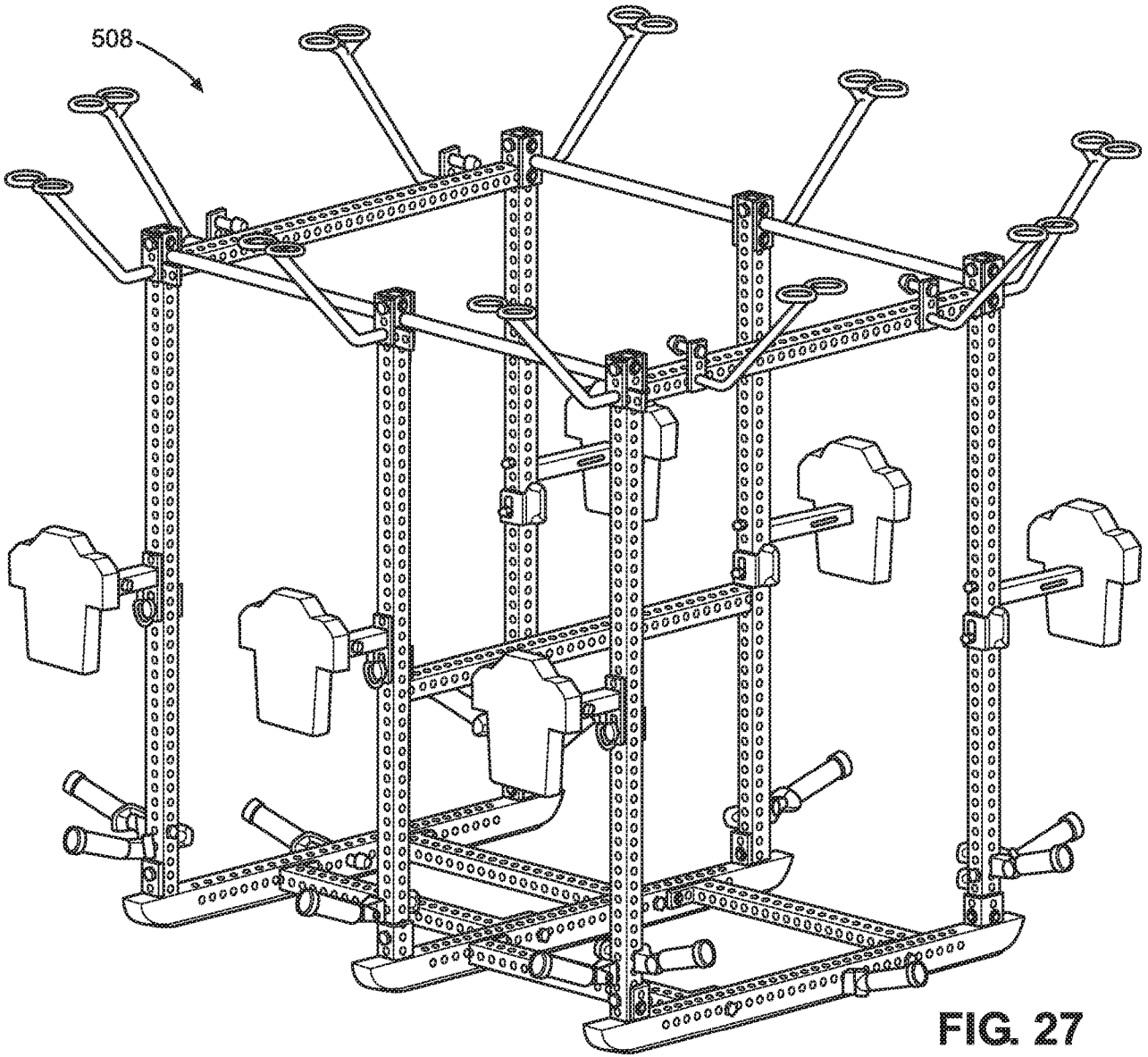
FIG. 27 is a view in perspective illustrating an alternative embodiment.

The alternative apparatus 508 of FIG. 27 has a similar plurality of vertical members, horizontal members, intermediate members and human interfaces mounted thereto.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An apparatus for human exercise comprising:

(a) a plurality of horizontal members assembled to form a base polygon having at least first and second skids disposed adjacent a surface upon which the apparatus rests, the at least first and second skids being substantially parallel to one another and configured to support the apparatus on the surface and slide along the surface in a direction parallel to the at least first and second skids when a sufficient lateral force is applied to the apparatus;

(b) at least first and second wheels mounted to the base polygon for selectively supporting the apparatus on the surface;

(c) at least three spaced, substantially vertical members, each of which has a lower vertical member end rigidly and removably mounted to the base polygon;

(d) a plurality of horizontal members assembled to form a ceiling polygon, the ceiling polygon spaced from the base polygon and rigidly and removably mounted to the at least three vertical members; and (e) at least one human-interface removably mounted to at least one of the horizontal or vertical members;

wherein the first wheel is mounted near a first end of the first skid, the second wheel is mounted near a first end of the second skid, and further comprising a third wheel mounted near an opposite, second end of the first skid, and a fourth wheel mounted near an opposite, second end of the second skid;

wherein the wheels are configured to be moved between a ground-engaging position for selectively supporting the exercise apparatus on the surface and a non-ground-engaging position.

2. The apparatus in accordance with claim 1, further comprising at least one intermediate member extending between two of the vertical members, the at least one intermediate member being removably attached to the vertical members.

3. The apparatus in accordance with claim 1, wherein the wheels are removably mounted to the base polygon.

4. The apparatus in accordance with claim 1, further comprising fasteners removably mounting the at least one human-interface to the at least one of the members.

5. The apparatus in accordance with claim 1, wherein the first and second skids have downwardly-facing surfaces that contact the surface upon which the apparatus rests, and a third and a fourth of the plurality of horizontal members extend between, and attach to, the first and second skids at base junctures, wherein the third and fourth horizontal members have downwardly-facing surfaces that are spaced from the surface upon which the apparatus rests.

6. The apparatus in accordance with claim 1, wherein at least one horizontal member of the ceiling polygon further comprises two substantially parallel beams.

7. An exercise apparatus comprising:

(a) a base polygon having at least first, second, third and fourth members, each of the base polygon members being mounted together, wherein the first and third base polygon members are parallel first and second skids with downwardly-facing surfaces that contact a surface upon which the exercise apparatus rests, and the second and fourth base polygon members extend between, and attach to, the first and third base polygon members at base junctures, wherein the second and fourth base polygon members have downwardly-facing surfaces that are spaced from the surface upon which the exercise apparatus rests;

(b) at least first, second, third and fourth vertical members, each of the members mounted at a lower end to the base polygon near one of the base junctures;

(c) a ceiling polygon having first, second, third and fourth ceiling polygon members mounted together at ceiling junctures, wherein each of the vertical members attaches at an upper end to the ceiling polygon near one of the ceiling junctures; and (d) at least four wheels mounted to the base polygon and configured to be moved between a ground-engaging position for selectively supporting the exercise apparatus on the surface and a non-ground-engaging position.

8. The apparatus in accordance with claim 7, further comprising at least one intermediate member extending between two of the vertical members, the at least one intermediate member being removably attached to the vertical members.

9. The apparatus in accordance with claim 7, wherein the at least four wheels comprise a first wheel, a second wheel, a third wheel, and a fourth wheel, and wherein the first wheel is mounted near a first end of the first skid, the second wheel is mounted near a second, opposite end of the first skid, the third wheel is mounted near a first end of the second skid, and the fourth wheel is mounted near an opposite, second end of the second skid.

10. The apparatus in accordance with claim 7, wherein the wheels are removably mounted to the base polygon.

11. The apparatus in accordance with claim 7, further comprising fasteners removably mounting at least one human-interface to at least one of the base polygon, vertical or ceiling polygon members.

12. The apparatus in accordance with claim 7, wherein at least one member of the ceiling polygon members further comprises two substantially parallel beams.

13. A method of using an exercise apparatus, the method comprising:

(a) assembling a plurality of members to form a substantially horizontal base polygon having (i) at least first and second substantially parallel skids disposed adjacent a surface upon which the apparatus rests, and (ii) at least first, second, third and fourth wheels mounted to the base polygon in a non-ground-engaging position with all ground-engaging wheel components above the surface and configured to be moved to a ground-engaging position for supporting the exercise apparatus on the surface;

(b) mounting lower ends of at least three spaced, substantially vertical members rigidly to the base polygon;

(c) assembling a plurality of members to form a substantially horizontal ceiling polygon mounted rigidly to the vertical members and spaced from the base polygon;

(d) mounting at least one human-interface to at least one of the substantially vertical members or one of the plurality of members that form the substantially horizontal ceiling polygon; and (e) applying a force to the at least one human-interface sufficient to cause the apparatus to slide along the surface in a direction substantially parallel to the at least first and second skids.

14. The method in accordance with claim 13, further comprising moving at least the first and second wheels to a ground-engaging position, thereby spacing at least a portion of the first and second skids from the surface.

15. The method in accordance with claim 14, further comprising moving the third and fourth wheels to a ground-engaging position, thereby spacing the first and second skids from the surface.

16. The method in accordance with claim 14, further comprising interfacing with the human-interface without moving the apparatus relative to the ground.

* * * * *